US006479132B2

(12) United States Patent
Hedblom et al.

(10) Patent No.: US 6,479,132 B2
(45) **Date of Patent: *Nov. 12, 2002**

(54) PAVEMENT MARKING ARTICLES HAVING ENHANCED RETROREFLECTIVITY UNDER DRY OR WET CONDITIONS AND METHOD FOR MAKING SAME

(75) Inventors: Thomas P. Hedblom, Eagan, MN (US); Eric E. Rice, Woodbury, MN (US); Terry L. Bescup, Woodbury, MN (US); Joseph M. McGrath, Lake Elmo, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/034,912

(22) Filed: Dec. 27, 2001

(65) Prior Publication Data

US 2002/0146538 A1 Oct. 10, 2002

Related U.S. Application Data

(62) Division of application No. 09/175,523, filed on Oct. 20, 1998, now Pat. No. 6,365,262.

(51) Int. Cl.[7] ..... E01F 9/015

(52) U.S. Cl. ..... 428/143; 428/149; 428/325; 404/14; 359/536; 359/538; 359/540; 359/541

(58) Field of Search ..... 428/143, 149, 428/325; 404/14; 359/536, 538, 540, 541

(56) References Cited

U.S. PATENT DOCUMENTS

| | | | |
|---|---|---|---|
| 2,440,584 | A | 4/1948 | Heltzer et al. |
| 3,175,935 | A | 3/1965 | Vanstrum |
| 3,252,376 | A | 5/1966 | De Vries |
| 3,254,563 | A | 6/1966 | De Vries et al. |
| 3,274,888 | A | 9/1966 | Vanstrum et al. |
| 3,413,058 | A | 11/1968 | Tung et al. |
| 3,418,896 | A | 12/1968 | Rideout |
| 3,486,952 | A | 12/1969 | Vanstrum et al. |
| 3,556,637 | A | 1/1971 | Palmquist |
| 3,702,213 | A | 11/1972 | Schwab |
| 3,709,706 | A | 1/1973 | Sowman et al. |
| 3,795,435 | A | 3/1974 | Schwab |
| 3,849,351 | A | 11/1974 | Jorgensen |
| 3,891,451 | A | 6/1975 | Okazaki et al. |
| 3,894,791 | A | 7/1975 | Eigenmann |
| 3,935,158 | A | 1/1976 | Watanabe |
| 3,958,891 | A | 5/1976 | Eigenmann |
| 4,030,958 | A | 6/1977 | Stenemann |
| 4,055,377 | A | 10/1977 | Erickson et al. |
| 4,072,403 | A | 2/1978 | Eigenmann |
| 4,082,426 | A | 4/1978 | Brown |
| 4,104,102 | A | 8/1978 | Eagon et al. |
| 4,117,192 | A | 9/1978 | Jorgensen |
| 4,145,112 | A | 3/1979 | Crone et al. |
| 4,166,147 | A | 8/1979 | Lange et al. |

(List continued on next page.)

FOREIGN PATENT DOCUMENTS

| | | |
|---|---|---|
| EP | 0 385 746 | 9/1990 |
| EP | 0 683 403 A2 | 11/1995 |
| WO | WO 97/01675 | 1/1997 |
| WO | WO 97/01677 | 1/1997 |
| WO | WO 97/28470 | 8/1997 |

OTHER PUBLICATIONS

Defensive Publication T987,003.
ASTM E810–94.
ASTM E809–94A.

*Primary Examiner*—William P. Watkins, III
(74) *Attorney, Agent, or Firm*—James V. Lilly

(57) ABSTRACT

The articles of the present invention comprise pavement marking articles which are retroreflective under dry and/or wet conditions. The articles comprise a monolayer of exposed-lens optical elements, a spacing layer, and a reflective layer. The present invention also provides a method of making said pavement marking articles.

32 Claims, 4 Drawing Sheets

Figure 1:
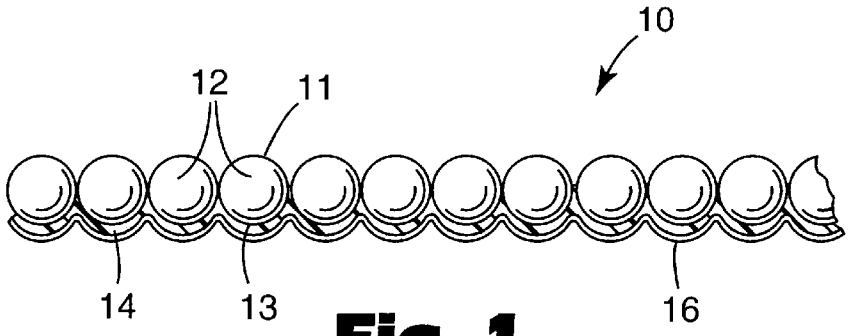

U.S. PATENT DOCUMENTS 4,203,878 A 5/1980 Bauer
4,226,658 A 10/1980 Carlson et al.
4,248,932 A 2/1981 Tung et al.
4,367,920 A 1/1983 Tung et al.
4,388,359 A 6/1983 Ethen et al.
4,411,553 A 10/1983 Eigenmann
4,490,432 A 12/1984 Jordan
4,505,967 A 3/1985 Bailey
4,511,210 A 4/1985 Tung et al.
4,564,556 A 1/1986 Lange
4,569,857 A 2/1986 Tung et al.
4,618,525 A 10/1986 Chamberlain et al.
4,648,932 A 3/1987 Bailey
4,652,172 A 3/1987 Eigenmann
4,664,966 A 5/1987 Bailey et al.
4,678,695 A 7/1987 Tung et al.
4,681,401 A 7/1987 Wyckoff
4,682,852 A 7/1987 Weber
4,758,469 A 7/1988 Lange
4,767,659 A 8/1988 Bailey et al.
4,772,511 A 9/1988 Wood et al.
4,875,798 A 10/1989 May
4,937,127 A 6/1990 Haenggi et al.
4,950,525 A 8/1990 Bailey
4,969,713 A 11/1990 Wyckoff
4,983,458 A 1/1991 Dejaiffe
4,988,541 A 1/1991 Hedblom
4,988,555 A 1/1991 Hedblom
5,008,142 A 4/1991 Wilson et al.
5,053,253 A 10/1991 Haenggi et al.
5,077,117 A 12/1991 Harper et al.
5,087,148 A 2/1992 Wyckoff
5,094,902 A 3/1992 Haenggi et al.
5,108,218 A 4/1992 Wyckoff
5,114,193 A 5/1992 Nass
5,124,178 A 6/1992 Haenggi et al.
5,139,590 A 8/1992 Wyckoff
5,207,852 A 5/1993 Lightle et al.
5,227,221 A 7/1993 Hedblom
5,268,789 A 12/1993 Bradshaw
5,316,406 A 5/1994 Wyckoff
5,316,838 A 5/1994 Crandall et al.
5,417,515 A 5/1995 Hachey et al.
5,478,596 A 12/1995 Gurney
5,557,461 A 9/1996 Wyckoff
5,571,362 A 11/1996 Hachey et al.
5,620,775 A 4/1997 LaPerre
5,643,655 A 7/1997 Passarino
5,667,334 A 9/1997 Boyce
5,667,335 A 9/1997 Khieu et al.
5,670,227 A 9/1997 Hedblom et al.
5,676,488 A 10/1997 Hedblom
5,750,191 A 5/1998 Hachey
5,759,928 A 6/1998 Harper
5,774,265 A 6/1998 Mathers et al.
5,777,791 A 7/1998 Hedblom
5,812,317 A 9/1998 Billingsley et al.
5,822,120 A 10/1998 Palazzotto et al.
5,917,652 A 6/1999 Mathers et al.

PAVEMENT MARKING ARTICLES HAVING ENHANCED RETROREFLECTIVITY UNDER DRY OR WET CONDITIONS AND METHOD FOR MAKING SAME

This is a divisional of application Ser. No. 09/175,523, filed Oct. 20, 1998, now U.S. Pat. No. 6,365,262.

FIELD OF THE INVENTION

The present invention relates to pavement markings comprising optical elements and/or skid-resistant particles. More particularly, the present invention relates to pavement markings having enhanced retroreflectivity under dry and/or wet conditions.

BACKGROUND OF THE INVENTION

The use of pavement markings (e.g., paints, retroreflective elements, tapes, and raised pavement markings) to guide and direct motorists traveling along a roadway is well known. These pavement markings often are retroreflective so motorists can see the markings at night. However, when the roadway is wet, for example from rainfall, the pavement marking in turn becomes wet and often the retroreflective performance diminishes.

Retroreflection describes the mechanism where light incident on a surface is reflected so that much of the incident beam is directed back toward its source. When the surface of the pavement marking becomes wet, the optical elements (i.e., transparent, substantially spherical, glass or ceramic lenses) become coated with water, which typically reduces retroreflection. When optical elements become wetted or covered with water, the ratio of the refractive index at the exposed-lens surface changes which affects the light gathering.

To maintain good retroreflectivity during wet conditions, raised pavement markings, preformed pavement marking tapes, particularly those having raised patterned surfaces, retroreflective elements, and large diameter optical elements have been developed.

Examples of raised pavement markers include, but are not limited to, U.S. Pat. No. 4,875,798 (May et al.), U.S. Pat. No. 5,667,335 (Khieu et al.), and U.S. Pat. No. 5,667,334 (Boyce). Raised pavement markers may be used to elevate the retroreflective sheeting (i.e., raised pavement markers often comprise retroreflective sheeting (e.g., enclosed-lens, sealed-lens, or prismatic-lens sheeting)) on one or more surface(s) above any water or other liquids on the roadway. Raised pavement markings are often susceptible to scratching of the outer plastic surface. Typically, raised pavement markings are 1.3 centimeters to 3 centimeters in height. These scratches significantly reduce retroreflectivity under dry conditions. In addition, raised pavement markers are subject to damage from snowplows and often are used in combination with other forms of pavement markings to provide sufficient daytime guidance.

Preformed pavement marking tapes are generally classified as "flat" tapes or "patterned" tapes which have vertical surfaces (typically retroreflective protuberances or protrusions (see, e.g., U.S. Pat. Nos. 4,388,359 (Ethen et al.), 4,988,555 (Hedblom), 4,988,541 (Hedblom), 5,670,227 (Hedblom et al.) and 5,676,488 (Hedblom))). Many flat pavement marking tapes rely on an exposed-lens optical system comprising transparent microspheres (i.e., optical elements) partially embedded in a binder layer containing reflective pigment particles such as titanium dioxide or lead chromate. Enclosed lens pavement marking tapes are also known (e.g., WO97/01677).

Generally, patterned pavement marking tapes have better recovery of retroreflectivity after the rain has stopped because the rain will run off the raised or vertical portions. However, water may still coat the optical elements affecting the ratio of the refractive index and thus altering (and typically decreasing) retroreflectivity.

Examples of retroreflective elements include, but are not limited to, U.S. Pat. No. 5,750,191 (Hachey et al.), U.S. Pat. No. 5,774,265 (Mathers et al.), and WO97/28470 (Palazotto et al.).

U.S. Pat. Nos. 4,072,403 (Eigenmann) and 5,268,789 (Bradshaw) describe pavement markings having good wet and dry retroreflectivity. However, the outer surface of these pavement markings may be readily scratched which decreases the dry retroreflectivity. These pavement markings tend to be rather rigid, which can make adhesion to the road difficult. Further, these pavement markings may be difficult to manufacture. The pavement markings are discreet and thus, do not provide continuous wet or dry delineation.

U.S. Pat. No. 4,145,112 (Crone) describes a wet retroreflective optical system based on refracting and retroreflective optics. One disadvantage of this system is durability. The plastic surface may scratch which reduces dry and wet retroreflective performance, particularly because this system relies on a refracting surface and on a total internal reflecting surface.

Pavement markings having a mixture of microspheres having different refractive indices have been used to obtain dry and wet retroreflectivity. See for example, U.S. Pat. No. 5,777,791 (Hedblom). Here, the higher refractive index microspheres tend to be glass which is not as durable (i.e., more readily scratched) as the lower refractive index ceramic microspheres.

EP Patent No. 385746 B1 (Kobayashi et al.) discloses a pavement marking comprising a layer of large glass microspheres embedded in the top of retroreflective enclosed-lens type base sheeting. The retroreflective pavement marking is said to be particularly useful in rainy conditions because the larger glass microspheres are partially exposed in air.

Pavement markings comprising large glass microspheres tend to recover retroreflectivity quicker after rain has stopped falling. However, actual retroreflective performance during rain tends to be poor because water covers the microsphere surface. These larger glass microspheres often have a relatively low refractive index (e.g., 1.5), which yields lower dry and wet retroreflection.

The need exists for pavement marking articles having enhanced retroreflection when wet and which provide delineation in dry and in wet conditions, and in low visibility conditions improving driver knowledge of vehicle position thereby increasing driver safety.

SUMMARY OF THE INVENTION

The present invention provides pavement marking articles which are retroreflective under dry and/or wet conditions. Surprisingly, some embodiments of the present invention have enhanced retroreflection when exposed to water, for example, when wet by rainwater. These pavement marking articles can be preformed pavement marking tapes, retroreflective flakes, or retroreflective elements embedded in a preformed pavement marking tape or in a road binder.

The articles of the present invention comprise a monolayer of exposed-lens optical elements, a spacing layer, and a reflective layer.

When the articles are a preformed pavement marking tape, the articles typically further comprise one or more top layers, a base layer, and an adhesive layer.

When the articles are retroreflective elements, the articles further comprise a core layer.

The present invention also provides a means for making these retroreflective pavement marking articles. One method comprises the steps of:

(a) providing an exposed-lens film comprising:
  (i) a layer of exposed-lens optical elements;
  (ii) a spacing layer; and
  (iii) a reflective layer; and (b) embossing said exposed-lens film onto a preformed pavement marking tape.

Alternatively, one or more binder materials can be applied to the exposed-lens film prior to embossing the exposed-lens film onto the preformed pavement marking tape.

The film may be selectively applied to a preformed tape. For example, the film may be applied to only the vertical surfaces, only the protrusions, in a continuous stripe down or crossweb, etc. when applied to a preformed pavement marking tape.

Alternatively, the exposed-lens film composite can be laminated to a base layer comprising a plurality of protuberances.

FIGURES

FIG. 1 is a cross-section of a retroreflective pavement marking article 10 comprising a layer of optical elements 12 having an exposed-lens surface 11 and an embedded-lens surface 13, a spacing layer 14, and a reflective layer 16.

Figure 2:
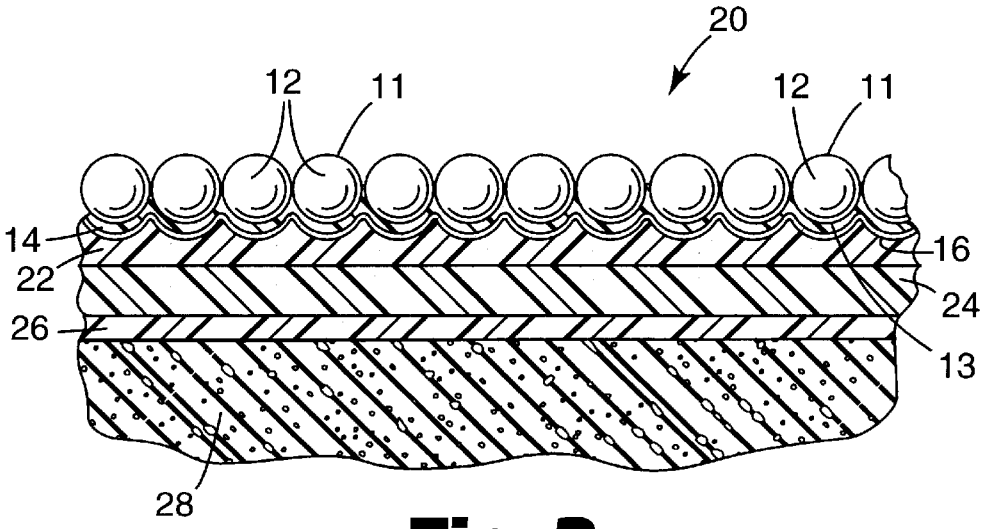

FIG. 2 is a cross-section of a retroreflective preformed pavement marking tape 20 comprising a layer of optical elements 12 having an exposed-lens surface 11 and an embedded-lens surface 13, a spacing 14, a reflective layer 16, a top layer 22, a base layer 24, and an adhesive layer 26 for bonding the preformed tape to a roadway surface 28.

Figure 3:
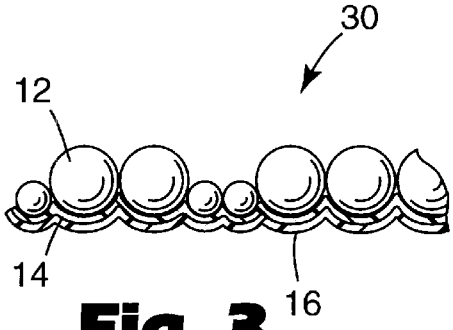

FIG. 3 is a cross-section of a retroreflective pavement marking article 30 comprising a layer of optical elements 12 where the optical elements have different average diameters, a spacing layer 14, and a reflective layer 16.

Figure 4:
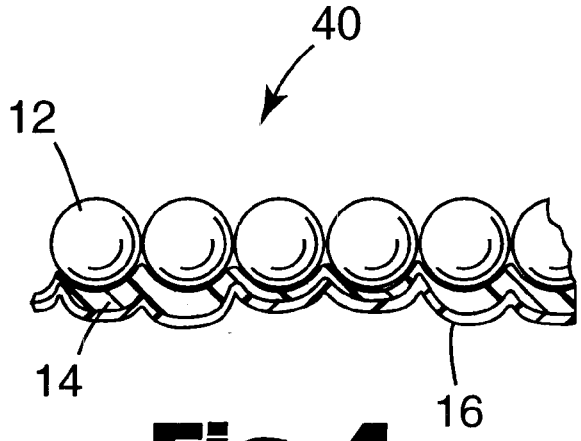

FIG. 4 is a cross-section of a retroreflective pavement marking article 40 comprising a layer of optical elements 12 having substantially the same average diameter, a spacing layer 14 having a variable thickness and a reflective layer 16.

Figure 5:
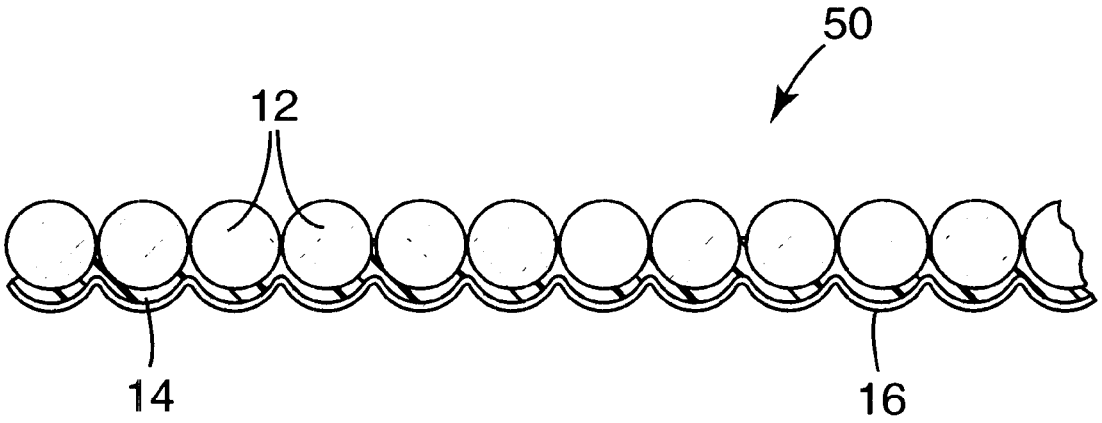

FIG. 5 is a cross-section of a retroreflective pavement marking article 50 comprising a layer of optical elements 12 having two different refractive indices, a spacing layer 14, and a reflective layer 16.

Figure 6:
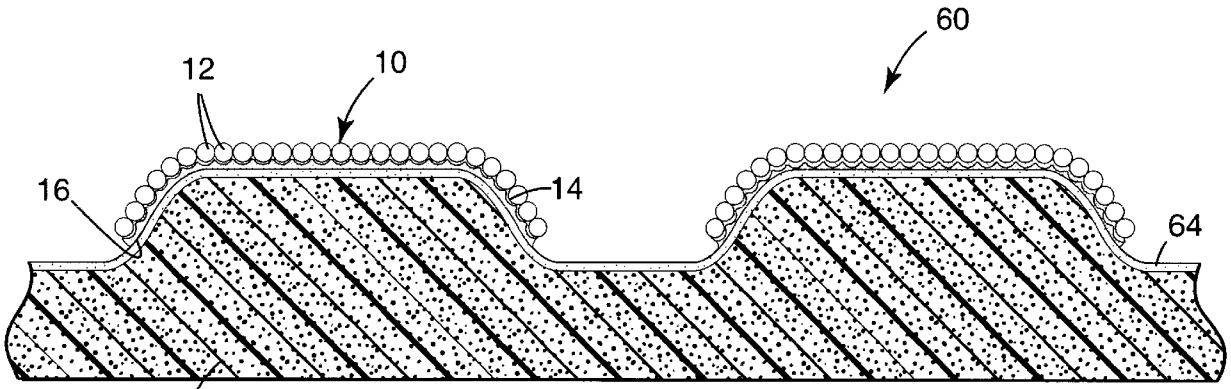

FIG. 6 is a cross-section of a preformed pavement marking tape 60 having protrusions where the protrusions have a layer of optical elements 12 with a spacing layer 14 on the embedded-lens surface side of the optical elements and a reflective layer 16 layered on the spacing layer embedded therein. The tape comprises a binder layer 64 and a base layer 62.

Figure 7:
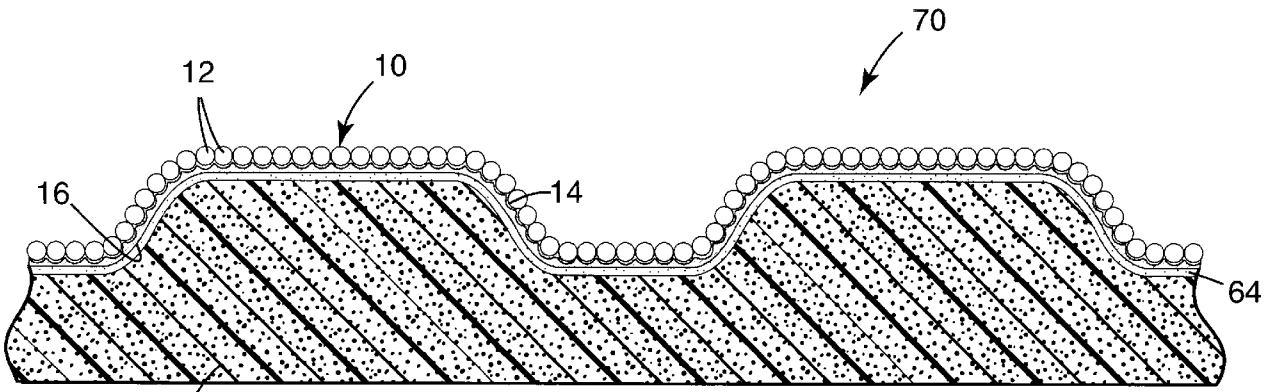

FIG. 7 is a cross-section of a preformed pavement marking tape 70 having protrusions, where a layer of optical elements 12 having a spacing layer 14 on the embedded-lens surface side of the optical elements and a reflective layer 16 layered on the spacing layer embedded in the binder layer 64 on the top surface of the preformed tape.

Figure 8:
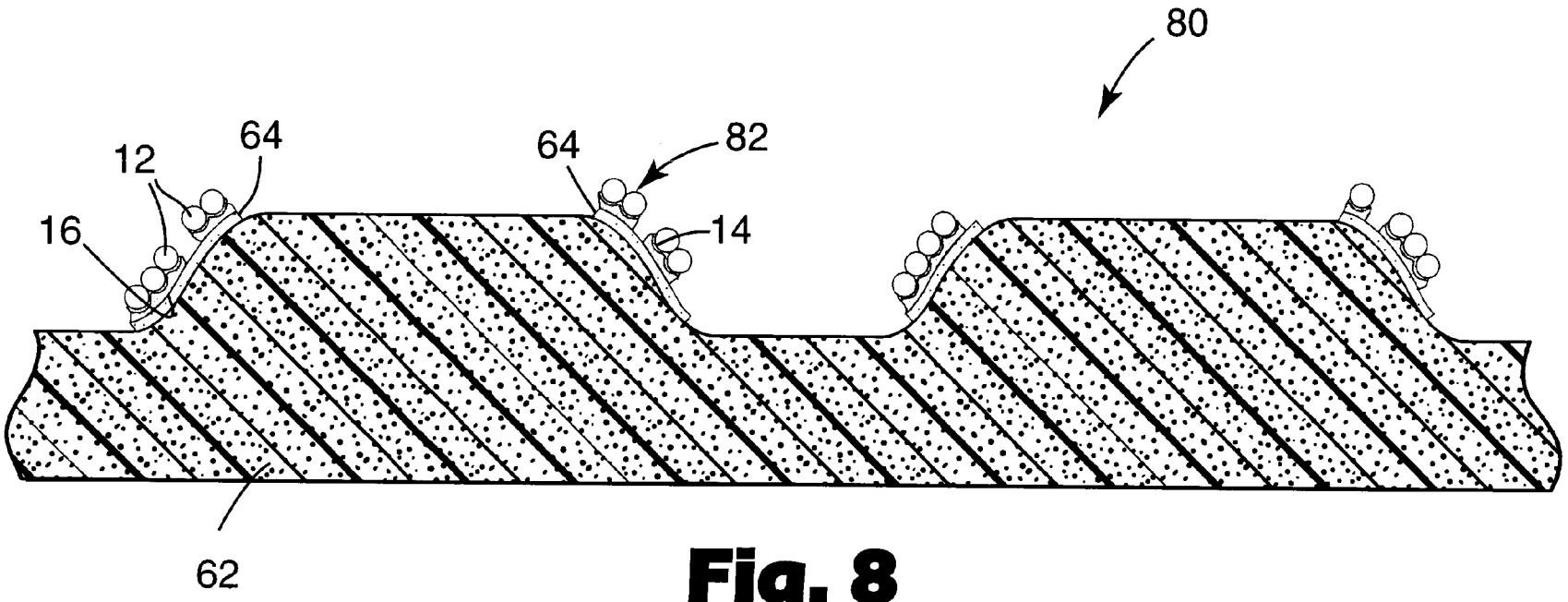

FIG. 8 is a cross-section of a preformed pavement marking 80 having protrusions, where a layer of optical elements 12 having a spacing layer 14 on the embedded-lens surface side of the optical elements and a reflective layer 16 layered on the spacing layer form a retroreflective flake 82 adhered to the preformed tape 80 with a binder layer 64.

The figures, which are idealized and not to scale, are intended to be merely illustrative and non-limiting.

DETAILED DESCRIPTION OF ILLUSTRATIVE EMBODIMENTS

The present invention provides a retroreflective pavement marking article comprising a monolayer of exposed-lens optical elements, a spacing layer, and a reflective layer. The pavement markings are retroreflective under wet and/or dry conditions.

The pavement marking articles are attached to the surface of a road or other traffic- bearing surface. These articles can be either preformed pavement marking tapes, retroreflective flakes, or retroreflective elements. The tapes are typically attached to the roadway with an adhesive. The retroreflective flakes may be adhered to a preformed pavement marking tape or attached to a traffic-bearing surface using a road binder material. The retroreflective elements may be adhered to a preformed pavement marking tape or attached to the traffic-bearing surface using a road binder material.

Pavement marking articles and other substantially horizontal markings typically exhibit high retroreflective brightness when the light is incident at high entrance angles (typically greater than about 85°). Retroreflective sheeting and other retroreflective articles attached to vertical surfaces, on the other hand, tend to exhibit high retroreflective brightness at lower entrance angles (e.g., within 30° to 40° of normal). Thus, the optical requirements of pavement marking articles differ from the optical requirements of retroreflective sheeting.

Optical Element Layer

A wide variety of optical elements are suitable in the present invention. The optical elements are exposed-lens. Exposed-lens is defined herein as having at least a portion of the optical element open to the air upon initial application to a traffic-bearing surface. After use on the traffic-bearing surface, the exposed-lens may become coated with oil, dust, road debris, etc. The portion of the optical element that is in contact with the spacing layer, or not the exposed-lens portion, is the embedded-lens portion.

However, various surface treatments may be present on the exposed-lens surface of the optical elements. For example, these treatments may be residual coatings used to enhance the adhesion of the optical element to the spacing layer. In addition, low adhesion topsize materials may be present on the exposed-lens surface to allow a preformed pavement marking tape article having an adhesive to be rolled-up and unwound. For retroreflective flakes and/or elements, various surface treatments may be present in small quantities on the surface of the optical elements (i.e., both the exposed-lens surface and the embedded-lens surface) to enhance the adhesion of the retroreflective flake and/or element to the binder or road binder and/or to modify the wicking of the binder or road binder around the retroreflective flake and/or element. In all these cases, the thin films or surface treatments on the exposed-lens optical elements may temporarily affect the wetting of rain on the surface of the marking.

Typically, for optimal retroreflective effect, the optical elements have a refractive index ranging from about 1.5 to about 2.0 for optimal dry retroreflectivity, preferably ranging from about 1.5 to about 1.8. For optimal wet retroreflectivity, the optical elements have a refractive index ranging from about 1.7 to about 2.4, preferably ranging from about 1.9 to 2.4, and more preferably ranging from about 1.9 to about 2.1.

The layer of optical elements may comprise optical elements having the same, or approximately the same refractive index. Alternatively, the layer of optical elements may comprise optical elements having two or more refractive indices. Typically, optical elements having a higher refractive index perform better when wet and optical elements having a lower refractive index perform better when dry. When a blend of optical elements having different refractive indices is used, the ratio of the higher refractive index optical elements to the lower refractive index optical elements is preferably about 1.05 to about 1.4, and more preferably from about 1.08 to about 1.3.

Generally, optical elements having about 50 to about 1000 micrometers average diameter (preferably about 50 to about 500 micrometers average diameter, and more preferably from about 150 to about 350 micrometers average diameter) are suitable for the present invention. The optical element layer may comprise optical elements having the same, or approximately the same average diameter. Alternatively, the optical element layer may comprise optical elements having two or more average diameters. Typically, optical elements having a larger average diameter perform better when dry, while optical elements having a smaller average diameter perform better when wet.

Blends of optical elements having both different average diameter and refractive index may be used. Typically, a larger average diameter lower refractive index optical element is used to achieve better dry retroreflectivity, while a smaller average diameter higher refractive index optical element is used to achieve better wet retroreflectivity.

The optical elements comprise an amorphous phase, a crystalline phase, or a combination, as desired. The optical elements preferably comprise inorganic materials that are not readily susceptible to abrasion. Suitable optical elements include, for example, microspheres formed of glass such as soda-lime-silicate glasses.

Microcrystalline ceramic optical elements as disclosed in U.S. Pat. Nos. 3,709,706; 4,166,147; 4,564,556; 4,758,469; and 4,772,511 have enhanced durability. Preferred ceramic optical elements are disclosed in U.S. Pat. Nos. 4,564,556, 4,772,511 and 4,758,469. These optical elements are resistant to scratching and chipping, are relatively hard (above 700 Knoop hardness). These ceramic optical elements may comprise zirconia, alumina, silica, titania, and mixtures thereof.

The optical elements can be colored to retroreflect a variety of colors. Techniques to prepare colored ceramic optical elements that can be used herein are described in U.S. Pat. No. 4,564,556. Colorants such as ferric nitrate (for red or orange) may be added in an amount of about 1 to about 5 weight percent of the total metal oxide present. Color may also be imparted by the interaction of two colorless compounds under certain processing conditions (e.g., $TiO_2$ and $ZrO_2$ may interact to produce a yellow color). The optical elements may be colored so that, for example, colorless, yellow, orange, or some other color of light is retroreflected at night.

The optical elements are typically partially embedded in the spacing layer in a hexagonal close-packed arrangement. In certain product applications, it may be advantageous to have the optical elements applied at less than the close-packed rate.

Spacing Layer

The pavement marking articles of the present invention comprise a spacing layer. The spacing layer "cups" the optical elements. The spacing layer comprises two major surfaces. The first major surface is in contact with the embedded-lens surface of the optical elements. The second major surface of the spacing layer is next to the reflective layer and follows a radius of curvature (preferably the radius of curvature is such that the spacing layer forms a concentric hemisphere with respect to the optical element) larger than the optical element with an origin approximately at the center of the optical element. This forms the "cup".

The spacing layer can be applied to the optical elements using various techniques, including, but not limited to, solution coating, curtain coating, extrusion, lamination, and powder coating. Processing the spacing layer into a cup may include, but is not limited to, solvent evaporation, sagging of the spacing layer under the forces of gravity, displacement of the spacing layer due to fluid forces, or electrostatic deposition. Solidification of the spacing layer can include, but is not limited to, drying, chemical reaction, temporary ionic bonds, or quenching.

Generally, the spacing layer is comprised of polyvinyl butyral, polyurethanes, polyesters, acrylics, acid olefin copolymers such as ethylene acrylic acid, ethylene methacrylic acid, and acid olefin copolymers neutralized with a base ("ionomers"), polyvinyl chloride and its copolymers, epoxies, polycarbonates, and mixtures thereof.

When selecting polymer systems for the spacing layer, optical transparency is a requirement. Generally, the spacing layer preferably has a 70% or greater transparency to visible light, more preferably, 80% or greater, and most preferably 90% or greater.

Various additives such as stabilizers, colorants, ultraviolet absorbers, antioxidants, etc. can be added to the spacing layer material to affect the processing, weathering, or retroreflective color.

The refractive index of the spacing layer generally ranges from about 1.4 to about 1.7, preferably from about 1.4 to about 1.6, and more preferably from about 1.45 to about 1.55.

The thickness of the spacing layer varies with the refractive index and the size of the optical elements. Generally, assuming the optical elements have the same refractive index and the same size (i.e., average diameter), the thicker the spacing layer, the better the optics when the pavement marking article is wet. Typically, the relative thickness of the spacing layer to the optical element radius ranges from about 0.05 to about 1.4, preferably from about 0.1 to about 0.9, and more preferably from about 0.2 to about 0.9.

For dry retroreflectivity, the optimal spacing layer thickness relative to the average radius of the optical element (for a refractive index ranging from about 1.5 to about 1.85) is given by the following formula for a 1.5 refractive index spacing layer:

$$\text{spacing layer thickness/optical element radius}=\exp[-6.89*(\text{optical element refractive index})+10.2]$$

The suitable range of the relative spacing layer thickness is about ±0.15 for low refractive index optical elements and about ±0.1 for high refractive index optical elements.

For wet retroreflectivity, the optimal spacing layer thickness relative to the average radius of the optical element (for a refractive index ranging from about 1.7 to about 2.4) is given by the formula for a 1.5 refractive index spacing layer:

$$\text{spacing layer thickness/optical element radius}=\exp[-3.99*(\text{optical elemen refractive index})+7.20]$$

The suitable range of the relative spacing layer thickness is about ±0.20 for low refractive index optical elements and about ±0.1 for high refractive index optical elements.

For other refractive indices for the spacing layer, some variation in the above equation will result. Lower refractive index spacing layers will lead to a decreased spacing layer thickness. Higher refractive index spacing layers will lead to an increased spacing layer thickness. Thinner spacing layers will generally yield an enhanced retroreflective angularity of the exposed-lens article.

The spacing layer may have the same, or approximately the same, thickness throughout the pavement marking article. Alternatively, the spacing layer thickness may vary across the pavement marking article (i.e., crossweb) and/or downweb. The spacing layer thickness may also vary sinusoidally downweb and/or crossweb. Suitable methods to vary the spacing layer thickness include, but are not limited to, extrusion with variable drawings speeds; extrusion with a profiled die; powdercoating with different web conductivities downweb and/or crossweb; and solution coating with a multiple orifice die.

Reflective Layer

The reflective layer may comprise either a diffuse reflector or a specular reflector.

The diffuse reflector typically comprises a diffuse pigment. Examples of useful diffuse pigments include, but are not limited to, titanium dioxide, zinc oxide, zinc sulfide, lithophone, zirconium silicate, zirconium oxide, natural and synthetic barium sulfates, and combinations thereof. The diffuse pigment is typically delivered to the back of the spacing layer via a polymeric coating. The polymeric coating may be applied using a variety of techniques such as knife coating, roll coating, extrusion, or powder coating.

Illustrative examples of suitable polymeric materials include thermoset materials and thermoplastic materials. Suitable polymeric material includes, but is not limited to, urethanes, epoxies, alkyds, acrylics, acid olefin copolymers such as ethylene/methacrylic acid, polyvinyl chloride/polyvinyl acetate copolymers, etc.

The specular reflector may be a specular pigment, a metallized layer, or multi- layered di-electric materials.

An example of a useful specular pigment is a pearlescent pigment. Useful pearlescent pigments include, but are not limited to, AFFLAIR™ 9103 and 9119 (obtained from EM Industries, Inc., N.Y.), Mearlin Fine Pearl #139V and Bright Silver #139Z (obtained from The Mearl Corporation, Briarcliff Manor, N.Y.).

The reflective layer may also comprise thin metallic films. These thin metallic films may be applied by precipitation (e.g., precipitation of silver nitrate), thermal evaporation in a vacuum (e.g., resistive heating of Ag, Al; exploding wire; laser evaporation; and the like), sputtering (e.g., glow discharge) and chemical methods (e.g., electrodeposition, chemical vapor deposition). Resistive heating of aluminum is the presently preferred method of coating thin metallic films.

Another suitable reflective layer includes multi-quarter wavelength layers of various dielectric materials. An odd number of stacks of high and low refractive index films can yield reflectances very close to 100 percent. These multilayer thin films can be applied by thermal evaporation and chemical methods.

Different combinations of spacing layer thickness, spacing layer refractive index, optical element diameter, and optical element refractive index may be used in the present invention. For example, two different refractive index optical elements having approximately the same average diameter may be combined with a spacing layer having a thickness which varies cross-web. Another example of a suitable combination is an optical element layer comprising two different average diameter optical elements having different refractive indices with a spacing layer having approximately the same thickness downweb and crossweb.

Preformed Pavement Marking Tapes

If desired, preformed pavement marking tapes may further comprise additional layers to improve the performance of the resultant pavement marking tape.

The tapes may comprise a top layer that typically is a top coat or a top film. The top layer is beneath the reflective layer. The top layer preferably adheres well to the reflective layer. The top layer may function as the binder layer (i.e., adhere the retroreflective article to the preformed pavement marking tape). Alternatively, the top layer may be located beneath the binder layer when the binder layer is present.

Useful top layers are known in the art. Examples of suitable top layers include both thermoplastic and thermoset polymeric materials.

Suitable polymeric materials include, but are not limited to, urethanes, epoxies, alkyds, acrylics, acid olefin copolymers such as ethylene/methacrylic acid, polyvinyl chloride/polyvinyl acetate copolymers, etc.

The top layer material may comprise pigments for color. Illustrative samples of common colorants include, but are not limited to Titanium Dioxide CI 77891 Pigment White 6 (DuPont, Wilmington, Del.), Chrome Yellow CI 77603 Pigment Yellow 34 (Cookson, Pigments, Newark, N.J.), Arylide Yellow CI 11741 Pigment Yellow 74 (Hoechst Celanese, Charlotte, N.C.), Arylide Yellow CI 11740 Pigment Yellow 65 (Hoechst Celanese, Charlotte, N.C.), Diarylide Yellow HR CI 21108 Pigment Yellow 83 (Hoechst Celanese, Charlotte, N.C.), Naphthol Red CI 12475 Pigment Red 170 (Hoechst Celanese, Charlotte, N.C.), IRGAZINE™ 3RLTN PY 110 CI Pigment Yellow (Ciba Specialty Chemical Corp., Tarrytown, N.Y.), Benzimidazolone H2G CI Pigment Yellow 120 (Hoechst Celanese, Charlotte, N.C.), and Isoindolinone CI Pigment Yellow 139 (Bayer Corp., Pittsburgh, Pa.).

The preformed pavement marking tapes may also comprise a base layer (e.g., a conformance layer) and/or an adhesive layer. These layers are located beneath the top layer. Many useful examples of such layers of preformed pavement marking tapes are well known and selection of suitable choices for particular embodiments of the invention may be readily made by one with ordinary skill in the art. Examples of suitable base layers include, but are not limited to, those disclosed in U.S. Pat. Nos. 4,117,192; 4,490,432; 5,114,193; 5,316,406; and 5,643,655. Suitable adhesives include, but are not limited to, pressure-sensitive adhesives, rubber resin adhesives, neoprene contact adhesives, etc.

Preformed pavement marking tapes of the present invention may be substantially flat or have protrusions.

Illustrative examples of substantially flat pavement marking tapes which may be modified to include the invention described herein, include, but are not limited to, U.S. Pat. Nos. 4,117,192; 4,248,932; 5,077,117; and 5,643,655.

Illustrative examples of tapes having protrusions which may be modified to include the invention described herein, include, but are not limited to U.S. Pat. No. 4,388,359, 4,988,555, 5,557,461, 4,969,713, 5,139,590, 5,087,148, 5,108,218, and 4,681,401. A preferred pavement marking tape having protrusions is disclosed in U.S. Pat. No. 5,670,227.

The tapes may also be removable for short-term usage.

Retroreflective Flakes

The retroreflective flakes comprise the optical layer, the spacing layer, and the reflective layer. The retroreflective flakes may also include one or more bottom layers adhered to the reflective layer. Generally, the retroreflective flakes are discreet segments of the retroreflective article which are attached to a preformed pavement marking tape or on a traffic-bearing substrate. The retroreflective flakes typically are adhered to a preformed pavement marking tape having protrusions. Preferably, the flakes are selectively adhered to just the vertical surfaces of the protrusions.

Suitable binder materials and road binder materials are described below.

The presently preferred area of the retroreflective flakes are approximately 0.04 to about 1.0 (millimeters)$^2$ and more preferably the flakes are about 0.04 to about 0.25 (millimeters).

Retroreflective Elements in a Road Binder

Another embodiment of the present invention is a retroreflective element attached to a preformed pavement marking tape or partially embedded in a road binder.

The retroreflective elements comprise the optical layer, the spacing layer, the reflective layer, and the core layer.

Suitable core layer material includes polymeric materials, both thermoplastic and thermoset materials and mixtures thereof. Particular examples of suitable material can be readily selected by those skilled in the art. Potential core layer materials can be selected from a wide range of thermoplastic materials. For example, non-crosslinked elastomer precursors (e.g., nitrile rubber formulations), ethylene-vinylacetate copolymers, polyesters, polyvinylacetate, polyurethanes, polyureas, acrylic resins, methacrylic resins, ethylene-acrylate/methacrylate copolymers, ethylene-acrylic acid/methacrylic acid copolymers, polyvinyl butyral, and the like are useful. The core layer material can be comprised of one or more resin materials.

Illustrative examples of thermoset materials useful for the core layer include amino resins, thermosetting acrylic resins, thermosetting methacrylic resins, polyester resins, drying oils, alkyd resins, epoxy and phenolic resins, polyurethanes based on isocyanates, polyureas based on isocyanates, and the like. Such compositions are described in detail in Organic Coatings: Science and Technology, Volume I: Film Formation, Components, and Appearance, Zeno W. Wicks, Jr., Frank N. Jones and S. Peter Pappas, ed., John Wiley & Sons, Inc., N.Y., 1992.

The presently preferred dimensions of the retroreflective elements are approximately about 1.0 to about 2.5 millimeters (about 40 to about 100 mil) thickness, about 0.50 to about 1.0 centimeter (about 3/16inch to about 3/8inch) width, and about 0.50 to about 10 centimeter (about 3/16to about 4 inches) length. The retroreflective elements may be any shape. However, the shape typically is rectangular or square.

The retroreflective article is attached to at least one surface of the core layer, and is typically attached to two or more surfaces of the core layer.

The retroreflective elements may be attached to either a flat or a protrusioned preformed tape. When the preformed tape has protrusions, the retroreflective elements preferably are adhered only to the "vertical" (i.e., generally up-right) surfaces of the protrusions, where they provide the most efficient retroreflection. However, the retroreflective elements may be attached to the top surface of the top layer of the preformed tape.

The retroreflective elements and/or flakes can be attached to the tape using a binder material. Suitable binder materials include, but are not limited to polyurethanes, polyureas, epoxy resins, polyamides, polyesters, and mixtures thereof and to those disclosed in U.S. Pat. Nos. 4,248,932, and 5,077,117 incorporated by reference herein.

Alternatively, a magnetic layer may be applied to the reflective layer of the retroreflective flake or element. The retroreflective flake or element may then be applied to a preformed pavement marking tape in the present of a magnetic field to help orient the retroreflective flake or element.

Road binders for pavement marking articles are well-known in the art. Suitable road binder materials include, but are not limited to, wet paint, thermoset materials, or hot thermoplastic materials (e.g., U.S. Pat. Nos. 3,849,351, 3,891,451, 3,935,158, 2,043,414, 2,440,584, 4,203,878, 5,478,596). Typically, retroreflective elements and/or flakes and skid-resistant particles are sprinkled or otherwise applied to a road binder material while it is in a liquid state. The retroreflective elements and/or flakes or particles become partially embedded in the road binder material while it is liquid. The road binder material subsequently becomes solid resulting in retroreflective elements and/or flakes and/or particles partially embedded therein. Typically, the paint or thermoset or thermoplastic material forms a matrix that serves to hold the pavement marking articles in a partially embedded and partially protruding orientation. The matrix can be formed from durable two component systems such as epoxies or polyurethanes, or from thermoplastic polyurethanes, alkyds, acrylics, polyesters, and the like. Alternate coating compositions that serve as a matrix and include the pavement marking articles described herein are also contemplated to be within the scope of the present invention.

Skid-Resistant Particles

Typically a retroreflective preformed pavement marking tape also comprises skid- resistant particles. Illustrative examples of particularly useful skid-resistant particles include those disclosed in U.S. Pat. Nos. 5,124,178; 5,094,902; 4,937,127; and 5,053,253. Skid-resistant particles may also be embedded in a retroreflective element, or embedded in a road-binder.

Generally, skid-resistant particles are randomly sprinkled and become embedded in the binder material while it is in a softened state. The skid-resistant particles may also be embedded in the spacing layer.

Method of Making Pavement Marking Articles

The retroreflective pavement marking articles of the present invention may be made by first making exposed-lens film and then placing this film in a vertical orientation using an embossing process.

The exposed-lens retroreflective film is made by first coating a cupping resin onto a liner such as polyethylene terephthalate (PET), paper, or the like. (See for example, U.S. Pat. No. 4,505,967 (Bailey) column 4, line 63). Suitable cupping resins include resins which have significantly lower viscosity than the spacing layer at the process temperature and which also exhibit low adhesion to the spacing layer (e.g., VITEL™ 3300 resin available from Bostik, Middleton, Mass.). The cupping resin (generally about 0.05 to about 0.25 millimeters thick) can be placed on the liner (generally about 0.01 to about 0.10 millimeters thick) by bar coating and forced air drying, extrusion, or hot melt coating. After drying, the cupping film can be wound up.

Next, the spacing layer (i.e., a substantially transparent film) is coated (e.g., extruded, powder coated) on top of the cupping film forming a composite spacing layer. The spacing layer may comprise, for example PRIMACOR 3440, (an extrusion grade thermoplastic, high molecular weight copolymer believed to comprise a major portion of ethylene monomer and a minor portion of acrylic acid monomer, available from Dow Chemical Co. Midland, Mich., having a melt flow index of about 10), a weather stabilizing system, and an antioxidant. This composite spacing layer is then wound up.

Several polymer processing techniques are useful for applying the spacing layer to the optical elements. When the optical elements have an average diameter less than about 100 microns, knife coating a polymeric solution on top of an optical element film will result in an adequately cupped spacing layer.

For larger retroreflective articles, powder coating produces a spacing layer having uniform thickness on the optical elements. In one example of powder coating, a polymer is made or ground to about 30 micron mean particle size. The powder is fluidized and conveyed with compressed air to an electrostatic spray gun where the powder is charged by corona or triboelectric methods. The powder is then sprayed towards the optical element film which is over a conductive substrate or base plate that is maintained at electrical ground. When the charged powder comes close to the grounded optical element film, the powder particles adhere due to electrostatic attraction. The dynamics of the electrostatic attraction are such that the powder tends to collect at a uniform thickness over the three dimensional optical element film. The powder coated optical element film is then passed through an oven to fuse the powder onto the substrate. Various fluidized bed powdercoating techniques can alternatively be employed to deliver a uniform thickness of powder over the optical element containing film prior to the powder fusing operation. Further processing may then take place.

A second film (i.e. the optical element carrier) is made by extruding a polyolefin (e.g., polyethylene) onto a liner such as PET, paper, or the like. The thickness of the polyolefin is commensurate with the optical element average radius. The second film is heated to a temperature about the melting temperature of the film (e.g. for polyethylene film, above 135° C.). The optical elements are then dropped from a dispenser and partially embedded, preferably to about 30% or more of their average diameter, into the softened second film to form a monolayer of optical elements. This optical element film composite is then wound up.

Optionally, the optical elements can be coated with a surface treatment such as silane to help the optical elements adhere to the spacing layer. For example, this surface treatment can be applied by reverse roll coating a solution of A1100 (available from Union Carbide, Danbury, Conn.) in deionized water and then drying.

The optical element film composite is then laminated to the composite spacing layer to partially embed the optical elements into the spacing layer. This may be accomplished by heating the composite spacing layer (i.e., run over a hot can or through an oven) and then laminating the two composites together using a nip to form "the laminate".

During the lamination step, the cupping film has a lower viscosity than the spacing layer. This helps the spacing layer form a more uniform cup around the optical element. The degree to which the spacing layer cups the optical element has an affect on the angularity of the retroreflective article.

Next, the cupping film is stripped away from the composite spacing layer which is now adhered to the optical elements. The spacing layer becomes exposed and is cured if desired (e.g., ultraviolet radiation, e-beam). A reflective layer (e.g., vapor coating an aluminum metallic layer) is formed on the exposed portion of the spacing layer. The optical element carrier is stripped away from the laminate, exposing the optical elements. The resulting article is then wound up. The resulting article includes the optical elements, and behind the optical elements is the spacing layer backed by a reflective layer (e.g., an aluminum vapor coat).

A top layer may be laminated to the reflective layer before or after removal of the optical element carrier. For example, a pigmented thermoplastic resin (e.g., EMAA film) may be laminated to the bottom side of the reflective layer (i.e., the side opposite the optical elements). The top layer may act as the binder layer or alternatively, a binder layer may be used to attach the retroreflective article (here a film) to a preformed pavement marking tape.

This retroreflective film can then be placed on the top surface of a preformed pavement marking tape by feeding the film into an embossing nip. Alternatively, the film can first be coated with a binder material and then be laminated to a preformed pavement marking tape having protrusions.

The film can be selectively placed on a preformed pavement marking tape by indexing. The film can be appropriately spaced such that when applied to the preformed tape, the film is located only on the vertical surfaces, only on the pattern of the tape, only on the protrusions, or only in stripes downweb or crossweb. Preferably at least 5 percent of the top surface area of the preformed pavement marking tape is covered with the retroreflective film.

Methods of Application

The preformed pavement marking tape articles of the present invention may be installed on a roadway or other location using any one of a variety of apparatus such as human pushable dispensers, "behind a truck" types of dispensers, and "built into a truck" type dispensers. U.S. Pat. No. 4,030,958 (Stenemann) discloses a suitable behind a truck type dispenser for applying the articles of the invention in the form of adhesive-backed tapes to a surface.

Other means may be used to install the pavement marking tape articles of the invention, such as simple manual application, or use of the previously mentioned mechanical fasteners.

Examples

The following examples further illustrate various specific features, advantages, and other details of the invention. The particular materials and amounts recited in these examples, as well as other conditions and details, should not be construed in a manner that would unduly limit the scope of this invention. Percentages given are by weight, unless otherwise specified.

Pavement marking examples 5 through 66 and 76 through 102 were prepared as follows. The top surface of the exposed-lens optical elements was scrubbed with toothpaste and a toothbrush. This scrubbing removes any low surface energy contamination on top of the optical elements and facilitates the rain wetting out the optics. The reflective layer-side of the exposed-lens optical element films was laminated using a pressure-sensitive adhesive to LEXAN™ pieces measuring 10 centimeters long, 0.64 centimeters wide and 3.0 millimeters in height. The exposed-lens films were attached to the 3.0 millimeter by 10 centimeter side. The exposed-lens optical element films were then trimmed to 3.0 millimeters by 10 centimeters producing a retroreflective element. The retroreflective elements were then mounted with a spacing of about 5.8 centimeters onto an aluminum panel measuring 1.5 millimeters thick by 10 centimeters wide by 1.5 meters long to produce a pavement marking example.

Optical Elements

| Refractive Index | Type | Average Diameter | Distribution Range | Description |
|---|---|---|---|---|
| 1.5 | Glass | 165 microns | 150–180 microns | Potters Industries, Inc. Hasbrouch Heights, NJ |
| 1.5 | Glass | 200 microns | 180–210 microns | Potters Industries, Inc. |
| | Glass | 1350 microns | 1000–1700 microns | Potters Industries, Inc. |
| 1.75 | Ceramic | 200 microns | 180–210 microns | Example 4 of U.S. Pat. No. 4,564,556 |
| 1.75 | Ceramic | 220 microns | 180–250 microns | Example 4 of U.S. Pat. No. 4,564,556 |
| 1.75 | Ceramic | 250 microns | 210–300 microns | Example 4 of U.S. Pat. No. 4,564,556 |
| 1.75 | Ceramic | 350 microns | 300–420 microns | Example 4, U.S. Pat. No. 4,564,556 |
| 1.91 | Ceramic | 165 microns | 150–180 microns | Example 1 of U.S. Pat. No. 4,772.511 |
| 1.91 | Glass | 275 microns | 250–300 microns | Potters Industries, Inc. |
| 1.91 | Glass | 460 microns | 420–500 microns | Potters Industries, Inc. |
| 1.93 | Glass | 65 microns | 53–74 microns | Nippon Electric Glass, Osaka, Japan Flex-O-Lite, St. Louis, MO |
| 2.26 | Glass | 65 microns | 53–74 microns | Nippon Electric Glass; Flex-O-Lite |

Various methods of manufacturing 1.75 ceramic optical elements are available, such as described in Example 4 of U.S. Pat. No. 4,564,556. In that Example, a stable, ion-exchanged zirconia sol was prepared by mixing a nitrate stabilized zirconia sol containing about 20% $ZrO_2$ by weight and about 0.83 M $NO_3$ per mole $ZrO_2$ (obtained from Nyacol Products Company), with an ion exchange resin (Amberlyst A-21 resin made by Rohm and Haase Company) in a ratio of about 100 g of sol to 15 g resin. To about 21 g of the resulting stable zirconia sol were added about seven grams of silica sol (Ludox LS), and then about 2.5 g of a 50% aqueous ammonium acetate solution were added to the sol with agitation. The resulting mixture (having a $Zr_2$:$SiO_2$ mole ratio of about 1:1) was immediately added to 500 ml of 2-ethylhexanol under agitation in a 600 ml beaker. After stirring for about five minutes, the mixture was filtered to separate the gel particles from the alcohol. Very transparent, rigid gelled spheres up to and exceeding 1 mm in diameter were recovered. The particles were dried and subsequently fired to 1000° C. Intact, transparent to slightly translucent spheres up to and over 500 micrometers in diameter were obtained.

Various methods of manufacturing 1.91 ceramic optical elements are available, such as described in Example 1 of U.S. Pat. No. 4,772,511 as modified herein. In that Example, 90.0 grams of aqueous colloidal silica sol, while being rapidly stirred, was acidified by the addition of 0.75 milliliter concentrated nitric acid. The acidified colloidal silica was added to 320.0 grams of rapidly stirring zirconyl acetate solution. 52.05 grams of Niacet aluminum formoacetate (33.4% fired solids) were mixed in 300 milliliters deionized water and dissolved by heating to 80° C. The solution, when cooled, was mixed with the zirconyl acetate-silica mixture described previously. The resulting mixture was concentrated by rotoevaporation to 35% fired solids. The concentrated optical element precursor solution was added dropwise to stirred, hot (88°–90° C.) peanut oil. The precursor droplets were reduced in size by the agitation of the oil and gelled.

Agitation was continued in order to suspend most of the resulting gelled droplets in the oil. After about one hour, agitation was stopped and the gelled microspheres were separated by filtration. The recovered gelled microspheres were dried in an oven for about 5 hours at about 78° C. prior to firing. The dried microspheres were placed in a quartz dish and fired in air by raising the furnace temperature slowly to about 900° C. over 10 hours, maintaining about 900° for 1 hour, and cooling the microspheres with the furnace. The initial firing of all the samples was done in a box furnace with the door slightly open. The optical element constituents were in the molar ration of $ZrO_2$:$Al_2O_3$:$SiO_2$ of 3:00:1.00:0.81

The coefficient of retroreflection (RA), in cd/Lux/$m^2$, following Procedure B of ASTM Standard E 809-94a, was measured at an entrance angle of −4.0 degrees and an observation angle of 0.2 degrees. The photometer used for those measurements is described in U.S. Defensive Publication No. T987,003.

The coefficient of Retroreflective Luminance, $R_L$, was measured for each pavement marking example at a geometry which approximates an automobile at 30 meters distance from the sample. The pavement marking examples were placed onto a table in a dark room. Above the pavement marking examples was a plumbing system capable of delivering a uniform artificial rainfall at a rate of about 3.3 centimeters per hour. The pavement marking examples were illuminated with projector lamps. The nominal entrance angle to the samples was 88.8 degrees. A photometer (IL 1700 Research Radiometer/Photometer by International Light, Inc.; Newburyport, Mass.) was used to measure the Illuminance on the sample. Typical illumination of the prototypes was about 70 Lux. A telephotometer (Digital Luminance Meter Series L 1000 by LMT; Berlin, Germany) was placed about 30 meters from the samples at a height corresponding to an observation angle of 1.05 degrees. The Luminance of each of the samples was measured with the telephotometer, units of cd/$m^2$. $R_L$ is calculated by dividing the Luminance of the sample by the Illuminance.

The rainfall measurements were made two ways. The first was a fast draining experiment. The pavement marking examples were rained on. The rainfall was allowed to drain immediately off the aluminum panels onto which the pavement marking examples were attached. When a steady state rain Luminance was achieved, the rainfall was turned off. The Luminance was allowed to recover and the steady state recovered Luminance again was measured. Typically, the steady state recovered Luminance after the rain was turned on or off took about 3 minutes. In the second experiment, the pavement marking examples were contained within a trough. The trough was nominally 15 centimeters wide by about 1.5 meters long by about 1.5 millimeters deep. The pavement marking examples were thus elevated to a height of 1.5 millimeters and contained within a trough of about 1.5 millimeters deep. This trough resulted in a significantly slower drainage of water from the pavement marking examples representing a higher rainfall rate. The steady state recovered Luminance was measured during the rainfall and after recovery.

Example 1 (Comparative)

A piece of 3M STAMARK™ High Performance Pavement Marking Tape Series 380 (available from Minnesota Mining and Manufacturing Co. ("3M"), St. Paul, Minn.) was installed on a low traffic volume roadway for a couple of months to remove the low adhesion topsize from the surface of the product. The piece of tape was then removed from the roadway. If present, the topsize can help shed water from the pavement marking which can give a false indication of overall wet retroreflective performance.

Example 2 (Comparative)

This sample is a piece of new 3M STAMARK™ High Performance Pavement Marking Tape Series 380.

Example 3 (Comparative)

This sample is a piece of 3M SCOTCHLANE™ Removable Tape Series 750 (available from 3M), which is a wet retroreflective product primarily for use in construction zones.

Example 4 (Comparative)

This sample is a flat preformed pavement marking tape having 1350 micron average diameter glass optical elements with a refractive index of 1.5. The optical elements were coated onto polyurethane (730 grams per square meter). The polyurethane contained 27 weight percent titanium dioxide pigment. A polyurethane solution was mixed using the following components:

| | |
|---|---|
| 27.0% | Rutile titanium dioxide pigment (available as TIPURE ™ R-960, from DuPont, New Johnsonville, TN.) |
| 25.1% | TONE ™ 0301 polyester polyol (available from Union Carbide Corp., Danbury, CT.) |
| 47.9% | DESMODUR ™ N-100 aliphatic polyisocyante (available from Bayer Corp., Pittsburgh, PA.) |

The thickness and the viscosity of the polyurethane were adjusted to get nominally 50 percent optical element embedment. The polyurethane was cured in an oven at about 120° C. for about 15 minutes.

Examples 1 through 4 were mounted on aluminum panels (1.5 millimeters thick, 10 centimeters wide and 1.5 meters long). The $R_L$ values were then measured for each example.

| EXAMPLE | OPTICAL ELEMENT REFRACTIVE INDEX | AVG. SIZE MICRONS | PRODUCT | REFLECTIVE LAYER |
|---|---|---|---|---|
| 1 | 1.75 | 220 | WEATHERED STAMARK ™ SERIES 380 | $TiO_2$ |
| 2 | 1.75 | 220 | NEW STAMARK ™ SERIES 380 | $TiO_2$ |
| 3 | 2.26 | 65 | SCOTCHLANE ™ SERIES 750 | Enclosed-lens Retroreflective Sheeting |
| 4 | 1.5 | 1350 | FLAT TAPE | $TiO_2$ |

| | CALCULATED COEFFICIENT OF RETROREFLECTED LUMINANCE - $R_L$ (mCd/m²/Lx) | | | | | |
|---|---|---|---|---|---|---|
| | FAST WATER DRAINAGE | | | SLOW WATER DRAINAGE | | |
| EX. | DRY | RAIN | RECOVERY | DRY | RAIN | RECOVERY |
| 1 | 980 | 32 | 48 | | | |
| 2 | 600 | 250 | 330 | 500 | 9 | 7 |
| 3 | 655 | 638 | 655 | 720 | 600 | 590 |
| 4 | 450 | 70 | 160 | 230 | 50 | 67 |

As witnessed during the slow rain experiment, $R_L$ values less than about 150 mCd/m²/Lx provide poor contrast and are not desirable for pavement marking articles. At $R_L$ values at about 300 mCd/m²/Lx adequate contrast was provided and acceptable pavement marking article delineation was provided. Excellent contrast and pavement marking delineation was obtained at $R_L$ values at about 600 mCd/m²/Lx. $R_L$ values greater than 1000 mCd/m²/Lx are highly desirable from pavement marking articles.

Examples 5–6 (Comparatives)

The polyurethane solution of Example 4 was coated onto a paper release liner using a notch bar. Optical elements having different refractive indices (as set forth in following table) were then flood coated onto the surface of the polyurethane and oven cured at about 120° C. for about 15 minutes. The coefficient of retroreflection ($R_A$) was measured. Retroreflective elements were then made as previously described. A pavement marking example was then made from the retroreflective elements as previously described. The coefficient of retroreflected luminance $R_L$ was then measured on the pavement marking example.

| EXAMPLE | OPTICAL ELEMENT REFRACTIVE INDEX | OPTICAL ELEMENT TYPE | AVG. SIZE MICRONS | SPACING LAYER | REFLECTIVE LAYER |
|---|---|---|---|---|---|
| 5 | 1.75 | CERAMIC | 220 | NONE | $TiO_2$ |
| 6 | 1.91 | CERAMIC | 165 | NONE | $TiO_2$ |
| 7 | 2.26 | GLASS | 65 | NONE | $TiO_2$ |
| 8 | 1.5 | GLASS | 200 | NONE | $TiO_2$ |

| | COEFFICIENT OF RETROREFLECTION (Cd/LX/M²) | | CALCULATED COEFFICIENT OF RETROREFLECTED LUMINANCE - $R_L$ (mCd/m²/Lx) | | | | | |
|---|---|---|---|---|---|---|---|---|
| | DRY | WET | FAST WATER DRAINAGE | | | SLOW WATER DRAINAGE | | |
| EX. | −4/0.2 | −4/0.2 | DRY | RAIN | RECOVERY | DRY | RAIN | RECOVERY |
| 5 | 8.5 | 0.8 | 2400 | 480 | 250 | 950 | 140 | 100 |
| 6 | 15.4 | 0.9 | 1500 | 300 | 390 | 1400 | 190 | 190 |
| 7 | 1.4 | 4.2 | 520 | 550 | 800 | 570 | 590 | 590 |
| 8 | 1.3 | 0.4 | 300 | 68 | 91 | 220 | 50 | 67 |

These examples illustrate that even in patterned pavement markings with minimized nighttime shadows, titanium dioxide filled systems do not have adequate wet contrast levels unless very high refractive index (2.26) optical elements are used. These very high refractive index optical elements are typically glass which typically has poor abrasion resistance.

Examples 9–11 (Comparatives)

A polyurethane solution was mixed using the following components:

| | |
|---|---|
| 35.0% | pearlescent pigment (AFFLAIR ™ 9119, available from EM Industries, Inc., Hawthorne, NY) |
| 22.3% | TONE ™ 0301 polyester |
| 42.7% | DESMODUR ™ N-100 aliphatic polyisocyanate |

The polyurethane solution was coated onto a paper release liner using a notch bar. Optical elements having different refractive indices (as set forth in the following table) were then flood coated onto the surface of the polyurethane and oven cured at about 120° C. for about 15 minutes. The coefficient of retroreflection ($R_A$) was measured. Retroreflective elements were then made as previously described. A pavement marking example was then made from the retroreflective elements as previously described. The coefficient of retroreflected luminance $R_L$ was then measured on the pavement marking example.

average diameter. A spacing layer solution was coated on top of the optical elements using a notch bar. The notch bar gap ranged from 0 to about 250 microns. The spacing layer solution consisted of:

23% Ethylene Glycol Monobutyl Ether solvent (obtained from Dow Chemical USA; Midland, Mich.; under the trade name DOWANOL™ EB)

48% #100 solvent (obtained from Shell Chemical Company; Baytown, Tex.; under the trade name CYCLOSOL™ 53)

4% AROPLAZ™1351 (obtained from Reichold Chemicals Inc.; Newark, N.J.)

18% BUTVAR™ B76 (obtained from Solutia Inc.; Trenton, Mich.)

7% Beckamine P138 (obtained from Reichold Chemicals Inc.; Newark, N.J.)

0.5% Tri-ethylamine (obtained from Air Products & Chemicals, Inc.; Shakopee, Minn.).

The spacing layer solution was dried and cured in a succession of ovens at about 65° C., about 77° C., about 150° C., about 155° C., and about 170° C. for about one minute each. No spacing layer was applied to the optical elements in Example 12.

The exposed portion of the spacing layer was vapor coated with aluminum as follows: The vacuum evaporator used was a NRC 3115 purchased from the Norton Company, Vacuum Equipment Division, Palo Alto, Calif. A sample

| EXAMPLE | OPTICAL ELEMENT REFRACTIVE INDEX | OPTICAL ELEMENT TYPE | AVG. SIZE MICRONS | SPACING LAYER | REFLECTIVE LAYER |
|---|---|---|---|---|---|
| 9 | 1.75 | CERAMIC | 220 | NONE | PEARL |
| 10 | 1.91 | CERAMIC | 165 | NONE | PEARL |
| 11 | 2.26 | GLASS | 65 | NONE | PEARL |

| | COEFFICIENT OF RETROREFLECTION (Cd/LX/M$^2$) | | CALCULATED COEFFICIENT OF RETROREFLECTED LUMINANCE - $R_L$ (mCd/m$^2$/Lx) | | | | | |
|---|---|---|---|---|---|---|---|---|
| | DRY | WET | FAST WATER DRAINAGE | | | SLOW WATER DRAINAGE | | |
| EX. | −4/0.2 | −4/0.2 | DRY | RAIN | RECOVERY | DRY | RAIN | RECOVERY |
| 9 | 18.9 | 0.7 | 4300 | 1300 | 1900 | 3400 | 220 | 220 |
| 10 | 61.3 | 1.0 | 2400 | 620 | 870 | 2100 | 370 | 320 |
| 11 | 1.1 | 14.9 | 390 | 1120 | 1700 | 400 | 1100 | 1100 |

These examples illustrate the magnitude of the impact that rain (slow water drainage) has on highly efficient patterned pavement marking articles having specular reflecting pigments and high refractive index optical elements (i.e., 1.91 refractive index). Very high refractive index optical elements (2.26) provide excellent contrast in the rain. These optical elements are typically glass which typically has poor abrasion resistance.

Examples 12–17

Glass optical elements having a 1.9 refractive index and an average diameter of 65 microns were embedded to approximately 40 percent of their average diameter in a polyethylene coated paper. The polyethylene coated paper was heated to about 135° C. and flood coated with glass optical elements preheated to about 135° C. The optical element coated web was maintained at about 135° C. for about an additional 3 minutes resulting in the glass optical elements becoming embedded to about 40 percent of their measuring roughly 15 centimeters×15 centimeters was placed at the top of the chamber in the bell jar so that the back of the spacing layer was in direct sight of the aluminum source. Aluminum wire was placed between the filament electrodes. The vacuum chamber was closed and then pumped down to a pressure of about $10^{-6}$ torr ($1.3\times10^{-3}$ dyne/cm$^2$). The evaporation filament power supply was turned on and the power increased to a level necessary to vaporize the aluminum wire. A quartz-crystal oscillator was used to monitor the aluminum deposition. The shutter over the aluminum source was closed after about 900 Angstroms of aluminum was deposited. The retroreflective article was then removed.

The coefficient of retroreflection ($R_A$) was measured. Retroreflective elements were then made as previously described. A pavement marking example was then made from the retroreflective elements as previously described. The coefficient of retroreflected luminance $R_L$ was then measured on the pavement marking example.

| EXAMPLE | OPTICAL ELEMENT REFRACTIVE INDEX | OPTICAL ELEMENT TYPE | AVG. SIZE MICRONS | SPACING LAYER | REFLECTIVE LAYER |
|---|---|---|---|---|---|
| 12 | 1.93 | GLASS | 65 | NONE | A1 VAPORCOAT |
| 13 | 1.93 | GLASS | 65 | 50 MICRON BAR GAP SOLVENT COATED | A1 VAPORCOAT |
| 14 | 1.93 | GLASS | 65 | 100 MICRON BAR GAP SOLVENT COATED | A1 VAPORCOAT |
| 15 | 1.93 | GLASS | 65 | 150 MICRON BAR GAP SOLVENT COATED | A1 VAPORCOAT |
| 16 | 1.93 | GLASS | 65 | 200 MICRON BAR GAP SOLVENT COATED | A1 VAPORCOAT |
| 17 | 1.93 | GLASS | 65 | 250 MICRON BAR GAP SOLVENT COATED | A1 VAPORCOAT |

| | COEFFICIENT OF RETRO-REFLECTION (Cd/LX/M$^2$) | | CALCULATED COEFFICIENT OF RETROREFLECTED LUMINANCE - $R_L$ (mCd/m$^2$/Lx) | | | | | |
|---|---|---|---|---|---|---|---|---|
| | DRY | WET | FAST WATER DRAINAGE | | | SLOW WATER DRAINAGE | | |
| EXAMPLE | −4/0.2 | −4/0.2 | DRY | RAIN | RECOVERY | DRY | RAIN | RECOVERY |
| 12 | 536 | 0.8 | 8400 | 150 | 190 | 9000 | 120 | 120 |
| 13 | 49.0 | 30.9 | 4100 | 650 | 1200 | 3300 | 780 | 810 |
| 14 | 13.1 | 35.6 | 1700 | 1700 | 2700 | 1400 | 1700 | 1600 |
| 15 | 11.6 | 115 | 870 | 2200 | 4100 | 900 | 2200 | 2600 |
| 16 | 11.1 | 133 | 710 | 2000 | 4000 | 860 | 2100 | 2400 |
| 17 | 10.5 | 46.0 | 600 | 940 | 1500 | 670 | 1000 | 1000 |
| 6 (Comparative) | 15.4 | 0.9 | 1500 | 300 | 390 | 1400 | 190 | 190 |
| 10 (Comparative) | 61.3 | 1.0 | 2400 | 620 | 870 | 2100 | 370 | 320 |
| 11 (Comparative) | 1.1 | 14.9 | 390 | 1200 | 1700 | 400 | 1100 | 1000 |

These examples illustrate the highly desirable levels of $R_L$ that can be achieved in the rain (slow water drainage) using a spacing layer. These articles having a spacing layer have much higher dry $R_L$ values than specular reflective pigment systems with very high refractive index optical elements (comparative 11).

Examples 18–23

Samples were prepared as described in Examples 12–17 substituting 165 micron average diameter ceramic optical elements. In addition, the spacing layer bar gaps were varied from 0 to about 250 microns. The coefficient of retroreflection ($R_A$) was measured. Retroreflective elements were then made as previously described. A pavement marking example was then made from the retroreflective elements as previously described. The coefficient of retroreflected luminance $R_L$ was then measured (the slow water drainage data was gathered at a later date) on the pavement marking example.

| EXAMPLE | OPTICAL ELEMENT REFRACTIVE INDEX | OPTICAL ELEMENT TYPE | AVG. SIZE MICRONS | SPACING LAYER | REFLECTIVE LAYER |
|---|---|---|---|---|---|
| 18 | 1.91 | CERAMIC | 165 | NONE | A1 VAPORCOAT |
| 19 | 1.91 | CERAMIC | 165 | 50 MICRON BAR GAP SOLVENT COATED | A1 VAPORCOAT |
| 20 | 1.91 | CERAMIC | 165 | 100 MICRON BAR GAP SOLVENT COATED | A1 VAPORCOAT |
| 21 | 1.91 | CERAMIC | 165 | 150 MICRON BAR GAP SOLVENT COATED | A1 VAPORCOAT |
| 22 | 1.91 | CERAMIC | 165 | 200 MICRON BAR GAP SOLVENT COATED | A1 VAPORCOAT |

-continued

| | | | | | |
|---|---|---|---|---|---|
| 23 | 1.91 | CERAMIC | 165 | 250 MICRON BAR GAP SOLVENT COATED | A1 VAPORCOAT |

| | COEFFICIENT OF RETRO-REFLECTION (Cd/LX/M$^2$) | | CALCULATED COEFFICIENT OF RETROREFLECTED LUMINANCE - $R_L$ (mCd/m$^2$/Lx) | | | | | |
|---|---|---|---|---|---|---|---|---|
| | DRY | WET | FAST WATER DRAINAGE | | | SLOW WATER DRAINAGE | | |
| EXAMPLE | −4/0.2 | −4/0.2 | DRY | RAIN | RECOVERY | DRY | RAIN | RECOVERY |
| 18 | 100 | 0.6 | 4500 | 270 | 380 | 4500 | 160 | 260 |
| 19 | 290 | 0.9 | 2700 | 280 | 310 | 5100 | 280 | 290 |
| 20 | 46.7 | 2.9 | 2200 | 270 | 300 | 4100 | 330 | 330 |
| 21 | 33.6 | 3.9 | 2000 | 300 | 340 | 3700 | 330 | 350 |
| 22 | 9.1 | 10.5 | 1400 | 570 | 600 | 2200 | 740 | 780 |
| 23 | 7.0 | 12.6 | 960 | 330 | 970 | 1500 | 970 | 970 |
| 6 (Comparative) | 15.4 | 0.9 | 1500 | 300 | 390 | 1400 | 190 | 190 |
| 10 (Comparative) | 61.3 | 1.0 | 2400 | 620 | 870 | 2100 | 370 | 320 |
| 11 (Comparative) | 1.1 | 14.9 | 390 | 1200 | 1700 | 400 | 1100 | 1100 |

These examples illustrate the excellent contrast that can be achieved in the rain (slow water drainage) using a spacing layer. These articles having a spacing layer have much higher dry $R_L$ values than specular reflective pigment systems with very high refractive index optical elements (comparative 11).

Examples 24–66

PRIMACOR™ 3440 (obtained from Dow Chemical USA, Midland, Mich.) was extruded onto a polyester film. The extruder conditions and web speeds were varied to produce film thickness ranging from about 50 to about 150 microns in 12.5 micron increments. The original extruded films were laminated together at a temperature of about 120° C. to obtain a thickness ranging from about 175 to about 300 microns. Optical elements were coated with a spacing layer as follows. The extruded films were placed on a hot plate polyester side-down at a temperature of about 205° C. Optical elements having various sizes were previously heated to the same temperature and were then flooded over the surface of the extruded film. The optical elements partially embedded in the extruded film (for about 30 seconds). The optical element-coated films were then removed and cooled. The polyester liner was removed. The optical element-coated film was then placed optical element side-down on the hot plate at about 205° C. surface for about 5 minutes. These conditions allowed the extrusion to sag down the optical element and form a concentric spacing layer (i.e., cupping). The spacing layer coated optical elements (i.e., spacing layer composite) was then removed and quenched in room temperature water.

Examples 24–33

Ceramic optical elements having a 165 micron average diameter were embedded in an extruded spacing layer having a thickness ranging from 0 to about 150 microns. After cupping the spacing layer, the films were vaporcoated with about 900 angstroms of aluminum as described in Examples 12–17. The coefficient of retroreflection ($R_A$) was measured. Retroreflective elements were then made as previously described. A pavement marking example was then made from the retroreflective elements as previously described. The coefficient of retroreflected luminance $R_L$ was then measured on the pavement marking example.

| EXAMPLE | OPTICAL ELEMENT REFRACTIVE INDEX | OPTICAL ELEMENT TYPE | AVG. SIZE MICRONS | SPACING LAYER | PIGMENT |
|---|---|---|---|---|---|
| 24 | 1.91 | CERAMIC | 165 | NONE | A1 VAPORCOAT |
| 25 | 1.91 | CERAMIC | 165 | 50 MICRON EXTRUDED | A1 VAPORCOAT |
| 26 | 1.91 | CERAMIC | 165 | 63 MICRON EXTRUDED | A1 VAPORCOAT |
| 27 | 1.91 | CERAMIC | 165 | 75 MICRON EXTRUDED | A1 VAPORCOAT |
| 28 | 1.91 | CERAMIC | 165 | 88 MICRON EXTRUDED | A1 VAPORCOAT |
| 29 | 1.91 | CERAMIC | 165 | 100 MICRON EXTRUDED | A1 VAPORCOAT |
| 30 | 1.91 | CERAMIC | 165 | 113 MICRON EXTRUDED | A1 VAPORCOAT |
| 31 | 1.91 | CERAMIC | 165 | 125 MICRON EXTRUDED | A1 VAPORCOAT |
| 32 | 1.91 | CERAMIC | 165 | 138 MICRON EXTRUDED | A1 VAPORCOAT |

-continued

| | | | | | |
|---|---|---|---|---|---|
| 33 | 1.91 | CERAMIC | 165 | 150 MICRON EXTRUDED | A1 VAPORCOAT |

| | COEFFICIENT OF RETRO-REFLECTION (Cd/LX/M$^2$) | | CALCULATED COEFFICIENT OF RETROREFLECTED LUMINANCE - $R_L$ (mCd/m$^2$/Lx) | | | | | |
|---|---|---|---|---|---|---|---|---|
| | DRY | WET | FAST WATER DRAINAGE | | | SLOW WATER DRAINAGE | | |
| EXAMPLE | −4/0.2 | −4/0.2 | DRY | RAIN | RECOVERY | DRY | RAIN | RECOVERY |
| 24 | 100 | 0.6 | 4500 | 270 | 380 | 4500 | 160 | 260 |
| 25 | 19.0 | 1.0 | 2300 | 410 | 570 | 2300 | 300 | 370 |
| 26 | 18.0 | 3.0 | 800 | 400 | 610 | 1600 | 330 | 460 |
| 27 | 15.0 | 7.0 | 980 | 540 | 860 | 910 | 520 | 690 |
| 28 | 9.0 | 22.0 | 570 | 1100 | 1700 | 570 | 1100 | 1400 |
| 29 | 8.0 | 57.0 | 520 | 1400 | 2200 | 500 | 1100 | 1200 |
| 30 | 8.0 | 78.0 | 470 | 950 | 1700 | 480 | 860 | 1600 |
| 31 | 7.0 | 38.0 | 430 | 380 | 820 | 420 | 270 | 370 |
| 32 | 7.0 | 41.0 | 470 | 470 | 980 | 470 | 440 | 660 |
| 33 | 5.0 | 9.0 | 520 | 300 | 590 | 510 | 180 | 240 |
| 6 (Comparative) | 15.4 | 0.9 | 1500 | 300 | 390 | 1400 | 190 | 190 |
| 10 (Comparative) | 61.3 | 1.0 | 2400 | 620 | 870 | 2100 | 370 | 320 |
| 11 (Comparative) | 1.1 | 14.9 | 390 | 1200 | 1700 | 400 | 1100 | 1100 |

These examples illustrate that extruded spacing layers on larger optical elements (165 microns) provide improved $R_L$ values in the rain (slow water drainage) than the solvent coated spacing layers of Examples 18–23. The examples also illustrate that the spacing layer articles can have better dry and raining $R_L$ values than specular reflective pigment systems (comparatives 10 and 11).

Examples 34–39

Samples were prepared as described in Examples 24–33 substituting a diffuse reflective layer onto the back of the spacing layer in place of the aluminum vaporcoat. The diffuse reflective layer consisted of a 27% by weight titanium dioxide filled polyurethane as described in Example 4. The coefficient of retroreflection ($R_A$) was measured. Retroreflective elements were then made as previously described. A pavement marking example was then made from the retroreflective elements as previously described. The coefficient of retroreflected luminance $R_L$ was then measured on the pavement marking example.

| EXAMPLE | OPTICAL ELEMENT REFRACTIVE INDEX | OPTICAL ELEMENT TYPE | AVG. SIZE MICRONS | SPACING LAYER | REFLECTIVE LAYER |
|---|---|---|---|---|---|
| 34 | 1.91 | CERAMIC | 165 | 50 MICRON EXTRUDED | $TiO_2$ |
| 35 | 1.91 | CERAMIC | 165 | 63 MICRON EXTRUDED | $TiO_2$ |
| 36 | 1.91 | CERAMIC | 165 | 75 MICRON EXTRUDED | $TiO_2$ |
| 37 | 1.91 | CERAMIC | 165 | 88 MICRON EXTRUDED | $TiO_2$ |
| 38 | 1.91 | CERAMIC | 165 | 100 MICRON EXTRUDED | $TiO_2$ |
| 39 | 1.91 | CERAMIC | 165 | 113 MICRON EXTRUDED | $TiO_2$ |
| 6 (Comparative) | 1.91 | CERAMIC | 165 | 113 MICRON EXTRUDED | $TiO_2$ |

| | COEFFICIENT OF RETRO-REFLECTION (Cd/LX/M$^2$) | | CALCULATED COEFFICIENT OF RETROREFLECTED LUMINANCE - $R_L$ (mCd/m$^2$/Lx) | | | | | |
|---|---|---|---|---|---|---|---|---|
| | DRY | WET | FAST WATER DRAINAGE | | | SLOW WATER DRAINAGE | | |
| EXAMPLE | −4/0.2 | −4/0.2 | DRY | RAIN | RECOVERY | DRY | RAIN | RECOVERY |
| 34 | 8.9 | 1.6 | 1000 | 290 | 370 | 770 | 200 | 230 |
| 35 | 7.6 | 2.1 | 650 | 430 | 600 | 480 | 300 | 330 |
| 36 | 7.0 | 3.0 | 490 | 480 | 670 | 380 | 370 | 530 |
| 37 | 6.4 | 3.8 | 430 | 510 | 680 | 330 | 380 | 480 |
| 38 | 6.7 | 4.5 | 400 | 490 | 620 | 320 | 400 | 550 |

-continued

| | | | | | | | | |
|---|---|---|---|---|---|---|---|---|
| 39 | 6.9 | 4.7 | 330 | 320 | 440 | 270 | 250 | 370 |
| 6 (Comparative) | 15.4 | 0.9 | 1500 | 300 | 390 | 1400 | 190 | 190 |

These examples illustrate how highly efficient patterned pavement marking articles having titanium dioxide reflective layers (comparative 6) can be improved using a spacing layer between the optical element layer and the reflective layer. Excellent contrast in the rain (slow water drainage) can be obtained with dry performance better than most newly painted lines.

Examples 40–45

Samples were prepared as described in Examples 34–39. A pearlescent pigmented polyurethane layer (35% by weight pearlescent pigment filled polyurethane as described in Examples 9–11) was coated onto the back of the spacing layer in place of the aluminum vaporcoat. The coefficient of retroreflection ($R_A$) was measured. Retroreflective elements were then made as previously described. A pavement marking example was then made from the retroreflective elements as previously described. The coefficient of retroreflected luminance $R_L$ was then measured on the pavement marking example.

These examples illustrate how highly efficient patterned pavement marking articles having specular reflective pigment reflective layers (comparative 10) can be improved by using a spacing layer between the optical element layer and the reflective layer. Excellent contrast in the rain (slow water drainage) can be obtained with dry performance being better than most newly painted lines.

Examples 46–55

Samples were prepared as described in Examples 24–33. 275 micron average diameter glass optical elements were substituted for the ceramic optical elements of Examples 24–33. The spacing layer thickness ranged from about 62.5 to about 225 microns. The coefficient of retroreflection ($R_A$) was measured. Retroreflective elements were then made as previously described. A pavement marking example was then made from the retroreflective elements as previously described. The coefficient of retroreflected luminance $R_L$ was then measured on the pavement marking sheeting.

| EXAMPLE | OPTICAL ELEMENT REFRACTIVE INDEX | OPTICAL ELEMENT TYPE | AVG. SIZE MICRONS | SPACING LAYER | REFLECTIVE LAYER |
|---|---|---|---|---|---|
| 40 | 1.91 | CERAMIC | 165 | 50 MICRON EXTRUDED | PEARL |
| 41 | 1.91 | CERAMIC | 165 | 63 MICRON EXTRUDED | PEARL |
| 42 | 1.91 | CERAMIC | 165 | 75 MICRON EXTRUDED | PEARL |
| 43 | 1.91 | CERAMIC | 165 | 88 MICRON EXTRUDED | PEARL |
| 44 | 1.91 | CERAMIC | 165 | 100 MICRON EXTRUDED | PEARL |
| 45 | 1.91 | CERAMIC | 165 | 113 MICRON EXTRUDED | PEARL |
| 10 (Comparative) | 1.91 | CERAMIC | 165 | NONE | PEARL |

| | COEFFICIENT OF RETRO-REFLECTION (Cd/LX/M$^2$) | | CALCULATED COEFFICIENT OF RETROREFLECTED LUMINANCE - $R_L$ (mCd/m$^2$/Lx) | | | | | |
|---|---|---|---|---|---|---|---|---|
| | DRY | WET | FAST WATER DRAINAGE | | | SLOW WATER DRAINAGE | | |
| EXAMPLE | −4/0.2 | −4/0.2 | DRY | RAIN | RECOVERY | DRY | RAIN | RECOVERY |
| 40 | 13.3 | 1.4 | 1400 | 330 | 430 | 1200 | 250 | 250 |
| 41 | 11.0 | 2.0 | 940 | 410 | 560 | 800 | 370 | 420 |
| 42 | 8.6 | 5.2 | 510 | 560 | 780 | 470 | 520 | 670 |
| 43 | 7.4 | 10.9 | 440 | 700 | 980 | 330 | 470 | 580 |
| 44 | 6.9 | 30.3 | 330 | 320 | 460 | 270 | 320 | 480 |
| 45 | 6.2 | 8.8 | 330 | 300 | 410 | 270 | 180 | 220 |
| 10 (Comparative) | 61.3 | 1.0 | 2400 | 620 | 870 | 2100 | 370 | 320 |

| EXAMPLE | OPTICAL ELEMENT REFRACTIVE INDEX | OPTICAL ELEMENT TYPE | AVG. SIZE MICRONS | SPACING LAYER | REFLECTIVE LAYER |
|---|---|---|---|---|---|
| 46 | 1.91 | GLASS | 275 | 63 MICRON EXTRUDED | A1 VAPORCOAT |
| 47 | 1.91 | GLASS | 275 | 88 MICRON EXTRUDED | A1 VAPORCOAT |
| 48 | 1.91 | GLASS | 275 | 100 MICRON EXTRUDED | A1 VAPORCOAT |
| 49 | 1.91 | GLASS | 275 | 113 MICRON EXTRUDED | A1 VAPORCOAT |
| 50 | 1.91 | GLASS | 275 | 125 MICRON EXTRUDED | A1 VAPORCOAT |
| 51 | 1.91 | GLASS | 275 | 138 MICRON EXTRUDED | A1 VAPORCOAT |
| 52 | 1.91 | GLASS | 275 | 150 MICRON EXTRUDED | A1 VAPORCOAT |
| 53 | 1.91 | GLASS | 275 | 175 MICRON EXTRUDED | A1 VAPORCOAT |
| 54 | 1.91 | GLASS | 275 | 200 MICRON EXTRUDED | A1 VAPORCOAT |
| 55 | 1.91 | GLASS | 275 | 250 MICRON EXTRUDED | A1 VAPORCOAT |
| 10 (comparative) | 1.91 | CERAMIC | 165 | NONE | PEARL |

| | COEFFICIENT OF RETRO-REFLECTION (Cd/LX/M$^2$) | | CALCULATED COEFFICIENT OF RETROREFLECTED LUMINANCE - $R_L$ (mCd/m$^2$/Lx) | | | | | |
|---|---|---|---|---|---|---|---|---|
| | DRY | WET | FAST WATER DRAINAGE | | | SLOW WATER DRAINAGE | | |
| EXAMPLE | −4/0.2 | −4/0.2 | DRY | RAIN | RECOVERY | DRY | RAIN | RECOVERY |
| 46 | 52.0 | 1.0 | 3400 | 410 | 720 | 3900 | 250 | 360 |
| 47 | 36.0 | 1.0 | 2700 | 420 | 750 | 3000 | 340 | 450 |
| 48 | 9.2 | 5.0 | 1400 | 570 | 990 | 1500 | 580 | 870 |
| 49 | 6.9 | 8.0 | 990 | 1200 | 1700 | 1100 | 1100 | 1500 |
| 50 | 4.8 | 15.0 | 830 | 1400 | 1800 | 920 | 1400 | 2200 |
| 51 | 4.2 | 24.0 | 630 | 1800 | 2100 | 680 | 1700 | 2700 |
| 52 | 3.4 | 54.0 | 610 | 1800 | 2400 | 610 | 1700 | 2700 |
| 53 | 3.0 | 69.0 | 510 | 1300 | 2100 | 590 | 1100 | 1300 |
| 54 | 2.9 | 17.6 | 500 | 580 | 850 | 590 | 390 | 710 |
| 55 | 2.8 | 5.1 | 480 | 300 | 470 | 630 | 250 | 280 |
| 10 (Comparative) | 61.3 | 1.0 | 2400 | 620 | 870 | 2100 | 370 | 320 |

These examples illustrate that large (275 micron) optical elements can have a spacing layer successfully applied by extrusion. Highly desirably dry and raining $R_L$ values can be obtained.

Examples 56–66

Samples were prepared as described in Examples 24–33. 460 micron average diameter glass optical elements were substituted for the ceramic optical elements of Examples 24–33. The spacing layer thickness ranged from about 100 to about 300 microns. The coefficient of retroreflection ($R_A$) was measured. Retroreflective elements were then made as previously described. A pavement marking example was then made from the retroreflective elements as previously described. The coefficient of retroreflected luminance $R_L$ was then measured on the pavement marking example.

| EXAMPLE | OPTICAL ELEMENT REFRACTIVE INDEX | OPTICAL ELEMENT TYPE | AVG. SIZE MICRONS | SPACING LAYER | REFLECTIVE LAYER |
|---|---|---|---|---|---|
| 56 | 1.91 | GLASS | 460 | 100 MICRON EXTRUDED | A1 VAPORCOAT |
| 57 | 1.91 | GLASS | 460 | 113 MICRON EXTRUDED | A1 VAPORCOAT |
| 58 | 1.91 | GLASS | 460 | 125 MICRON EXTRUDED | A1 VAPORCOAT |
| 59 | 1.91 | GLASS | 460 | 138 MICRON EXTRUDED | A1 VAPORCOAT |

-continued

| | | | | | |
|---|---|---|---|---|---|
| 60 | 1.91 | GLASS | 460 | 150 MICRON EXTRUDED | A1 VAPORCOAT |
| 61 | 1.91 | GLASS | 460 | 175 MICRON EXTRUDED | A1 VAPORCOAT |
| 62 | 1.91 | GLASS | 460 | 200 MICRON EXTRUDED | A1 VAPORCOAT |
| 63 | 1.91 | GLASS | 460 | 225 MICRON EXTRUDED | A1 VAPORCOAT |
| 64 | 1.91 | GLASS | 460 | 250 MICRON EXTRUDED | A1 VAPORCOAT |
| 65 | 1.91 | GLASS | 460 | 275 MICRON EXTRUDED | A1 VAPORCOAT |
| 66 | 1.91 | GLASS | 460 | 300 MICRON EXTRUDED | A1 VAPORCOAT |
| 10 (Comparative) | 1.91 | CERAMIC | 165 | NONE | PEARL |

| | COEFFICIENT OF RETRO-REFLECTION (Cd/LX/M$^2$) | | CALCULATED COEFFICIENT OF RETROREFLECTED LUMINANCE - $R_L$ (mCd/m$^2$/Lx) | | | | | |
|---|---|---|---|---|---|---|---|---|
| | DRY | WET | FAST WATER DRAINAGE | | | SLOW WATER DRAINAGE | | |
| EXAMPLE | −4/0.2 | −4/0.2 | DRY | RAIN | RECOVERY | DRY | RAIN | RECOVERY |
| 56 | 27.9 | 2.0 | 2700 | 650 | 760 | 3200 | 430 | 670 |
| 57 | 17.0 | 3.0 | 2100 | 650 | 750 | 2100 | 540 | 750 |
| 58 | 18.0 | 3.0 | 1900 | 660 | 700 | 2300 | 500 | 740 |
| 59 | 11.0 | 4.0 | 1500 | 690 | 840 | 1700 | 510 | 850 |
| 60 | 10.0 | 5.0 | 1200 | 740 | 870 | 1300 | 710 | 940 |
| 61 | 5.0 | 8.4 | 910 | 860 | 1300 | 1100 | 1000 | 1400 |
| 62 | 3.8 | 20.3 | 630 | 1300 | 1600 | 730 | 1200 | 1700 |
| 63 | 3.4 | 36.1 | 590 | 1500 | 2100 | 690 | 1200 | 2100 |
| 64 | 3.2 | 71.2 | 540 | 1100 | 2000 | 570 | 1100 | 1800 |
| 65 | 3.2 | 80.7 | 590 | 1600 | 2400 | 600 | 1000 | 2000 |
| 66 | 3.0 | 41.6 | 550 | 670 | 1000 | 570 | 460 | 800 |
| 10 (Comparative) | 61.3 | 1.0 | 2400 | 620 | 870 | 2100 | 370 | 320 |

These examples illustrate that very large (460 micron) optical elements can have a spacing layer successfully applied by extrusion. Highly desirable dry and raining $R_L$ values can be obtained.

Examples 67–74

Ceramic optical elements (refractive index 1.91) having an average diameter of about 165 microns were partially embedded into a polyethylene coated polyester film by flood coating in an oven at 135° C. to about 30% of their average diameter. The optical elements were wetted with a 0.15% dilute aqueous solution of gamma-aminopropyltriethoxysilane (obtained from Union Carbide Corporation; Danbury, Conn.), then dried in an oven at about 120° C. A pressure-sensitive adhesive was used to laminate the optical element film composite to an aluminum panel using a handroller. The aluminum panel was used to provide electrical grounding to the substrate during the powder coating operation. The aluminum panel measured about 15.2 centimeters by about 30.5 centimeters. The optical element film was then electrostatically powder coated with a powder of approximate 30 micron particle size made from ELVACITE™ 2013 (an acrylic copolymer available from ICI Acrylics Inc., Cordova, Tenn.). A NORDSON™ electrostatic powder spray gun operating at +80 kilovolts was mounted about 40 cm above electrically grounded rollers. The aluminum panel to which the optical element film was laminated was placed on the grounded rollers. The grounded rollers were driven at different speeds to affect the powder coating weight. Powder coating weights ranged from about 3.4 grams to about 6.6 grams for the 15 centimeters by 30 centimeters panel.

Assuming a 165 micron optical element average diameter size, perfect packing of the optical elements in the optical element carrier, a theoretical optimum spacing layer thickness of 71% of the radius, and a specific gravity of the ELVACITE™ 2013 powder of 1.15, then the calculated theoretical mass of ELVACITE™ 2013 powder is 5.5 grams per license plate.

Immediately after spraying, the powder coatings were fused onto the optical elements, conveyed through a series of ovens having heater temperatures at about 245° C., about 255° C., and about 320° C. for a total time of about 3 minutes. The web temperature ranged from about 120° C. and 150° C. The spacing layer was then vaporcoated with about 900 angstroms of aluminum as described in Examples 12–17. The vaporcoat side was then coated with an epoxy onto a rigid piece of aluminum. After the epoxy was cured, the polyethylene coated polyester optical element carrier was stripped off of the optical elements. The Coefficient of Retroreflection, $R_A$, was measured at −4.0/0.2 for both dry and under water conditions. The results are given in the following table:

| | Powder coating weight | Coefficient of Retroreflection, $R_A$, in cd/lx/m$^2$ | |
|---|---|---|---|
| EXAMPLE | per 15 cm by 30 cm | −4.0/0.2 Dry | −4.0/0.2 Wet |
| 67 | 6.6 grams | 6.9 | 7.2 |
| 68 | 6.1 grams | 6.8 | 18 |
| 69 | 5.5 grams | 4.9 | 27 |
| 70 | 5.0 grams | 8.4 | 44 |

-continued

| EXAMPLE | Powder coating weight per 15 cm by 30 cm | Coefficient of Retroreflection, $R_A$, in cd/lx/m$^2$ −4.0/0.2 Dry | −4.0/0.2 Wet |
|---|---|---|---|
| 71 | 4.3 grams | 15 | 34 |
| 72 | 4.0 grams | 8.3 | 11 |
| 73 | 3.4 grams | 23 | 3.2 |
| 74 | 3.0 grams | 19 | 4.8 |

These examples illustrate that spacing layer can be applied to moderate sized optical elements (165 microns) by using powder coating.

Example 75

To form a white base layer material, the ingredients in the following table were mixed in a Banbury internal mixer where they reached an internal temperature of approximately 150° C. The material was then cooled on a rubber mill and calendered into a sheet having a thickness of about 1.4 millimeters.

| COMPONENT | PARTS |
|---|---|
| Acrylonitrile-butadiene non-crosslinked elastomer precursor (Nipol 1022, Zeon Chemicals, Inc.; Louisville, KY) | 100 |
| Talc platelet filler particles averaging 2 microns in size (MISTRON SUPERFROST ™, Luzenac America, Inc.; Englewood, CO) | 100 |
| 3 denier polyester filament 6 mm long (SHORT STUFF ™ 6-3025, Mini Fibers, Inc.; Johnson City, TN) | 10 |
| Fibers of high-density polyethylene having a molecular weight ranging between 30,000 and 150,000 (SHORT STUFF ™ 13038F, Mini Fibers, Inc.) | 20 |
| Phenol type anti-oxidant (SANTO WHITE ™ crystals, Monsanto Co.; Nitro, Wv) | 2 |
| Chlorinated paraffin (CHLOREZ ™ 7005, Dover Chemical Corp.; Dover, OH) | 70 |
| Chlorinated paraffin (PAROIL ™ 140LV, Dover Chemical Corp.; Lake Charles, LA) | 5 |
| Spherical silica reinforcing filler (HISIL ™ 233, PPG Industries, Inc.; Lake Charles, LA) | 20 |
| Stearic acid processing aide Hamko Chemical; Memphis, TN | 1.0 |
| Chelator (VANSTAY ™ SC, R.T. Vanderbilt Company, Inc.; Norwalk, CT) | 0.5 |
| Ultramarine blue 5016 (Whittacker, Clark & Daniels, Inc.; South Plainfield, NJ) | 0.5 |
| Rutile titanium dioxide pigment (TIPURE ™ R-960, Dupont; New Johnsonville, TN) | 130 |
| Transparent glass microspheres averaging about 100 microns in diameter and having a refractive index of 1.5 (Flex-O-Lite, Inc.; Muscatine, IA) | 280 |
| TOTAL | 739 |

A thermoplastic topcoat was prepared by extruding a pigment concentrate blended with a thermoplastic. The pigment concentrate consists of 50% rutile titanium dioxide compounded with 50% ethylene methacrylic acid copolymer (NUCREL™ 699 by Dupont Wilmington, Del.). The pigment concentrate was supplied by M. A. Hanna Color, Elk Grove Village, Ill. 40% of the pigment concentrate was blended with 60% of additional NUCREL™ 699 and extruded to a thickness of about 1.1 millimeters. The extrusion was trimmed to a width of about 15 centimeters.

The spacing layer-coated and vaporcoated optical elements of Example 15 were cut into stripes about 1 centimeters wide and 15 centimeters long. The vaporcoat side of the film was laminated transversely on the extruded thermoplastic topcoat. The spacing layer coated stripes were spaced about 6 centimeters apart. The thermoplastic topcoat was heated to about 100° C. At this temperature the vaporcoat adhered tightly to the topcoat.

A 15 centimeters wide white base layer material was passed over a hot roll and heated to a temperature of about 140° C. The base layer was then passed through an embossing nip. The pattern on the embossing roll was the same as is used in the production of 3M STAMARK™ High Performance Pavement Marking Tape Series 380, available from 3M. The embossing roll was maintained at a temperature of about 40° C. The anvil roll was maintained at a temperature of about 25° C. The base layer was embossed at a pressure of about 8000 Newtons/cm. The thermoplastic topcoat with the laminated spacing layer was fed over the pattern roll into the embossing nip. The spacing layer side of the topcoat was against the pattern roll. Immediately after embossing the thermoplastic topcoat to the base layer the pavement marking product was cooled to room temperature. When viewed with a flashlight, the spacing layer-coated optical elements had very good dry retroreflectivity. The pavement marking was then submersed in water. When viewed with a flashlight the spacing layer-coated optical elements had improved retroreflectivity.

Examples 76–84

Glass optical elements having a refractive index of about 1.5 were embedded in the extruded spacing layer of Examples 24–66. The spacing layer thickness was varied from about 50 to about 150 microns. The glass optical elements were embedded and cupped by the extruded spacing layer in a similar manner as Examples 24–66 except the temperature was about 175° C. After cupping the spacing layer, the films were vaporcoated with about 900 angstroms of aluminum. The coefficient of retroreflection ($R_A$) was measured. Retroreflective elements were then made as previously described. A pavement marking example was then made from the retroreflective elements as previously described. The coefficient of retroreflected luminance $R_L$ was then measured on the pavement marking example.

| EXAMPLE | OPTICAL ELEMENT REFRACTIVE INDEX | OPTICAL ELEMENT TYPE | AVG. SIZE MICRONS | SPACING LAYER | REFLECTIVE LAYER |
|---|---|---|---|---|---|
| 76 | 1.5 | GLASS | 200 | 50 MICRON EXTRUDED | A1 VAPORCOAT |
| 77 | 1.5 | GLASS | 200 | 63 MICRON EXTRUDED | A1 VAPORCOAT |

-continued

| | | | | | |
|---|---|---|---|---|---|
| 78 | 1.5 | GLASS | 200 | 75 MICRON EXTRUDED | A1 VAPORCOAT |
| 79 | 1.5 | GLASS | 200 | 88 MICRON EXTRUDED | A1 VAPORCOAT |
| 80 | 1.5 | GLASS | 200 | 100 MICRON EXTRUDED | A1 VAPORCOAT |
| 81 | 1.5 | GLASS | 200 | 113 MICRON EXTRUDED | A1 VAPORCOAT |
| 82 | 1.5 | GLASS | 200 | 125 MICRON EXTRUDED | A1 VAPORCOAT |
| 83 | 1.5 | GLASS | 200 | 138 MICRON EXTRUDED | A1 VAPORCOAT |
| 84 | 1.5 | GLASS | 200 | 150 MICRON EXTRUDED | A1 VAPORCOAT |

| | COEFFICIENT OF RETROREFLECTION IN Cd/LX/M$^2$ | | CALCULATED COEFFICIENT OF RETROREFLECTED LUMINANCE - $R_L$ (mCd/m$^2$/Lx) | | |
|---|---|---|---|---|---|
| | DRY | WET | SLOW WATER DRAINAGE | | |
| EXAMPLE | −4.0/0.2 | −4.0/0.2 | DRY | RAIN | RECOVERY |
| 76 | 5.3 | 0.5 | | | |
| 77 | 9.5 | 0.8 | | | |
| 78 | 11 | 1.0 | | | |
| 79 | 22 | 1.3 | | | |
| 80 | 37 | 1.6 | | | |
| 81 | 63 | 2.0 | | | |
| 82 | 150 | 2.5 | 1500 | 120 | 180 |
| 83 | 110 | 2.7 | | | |
| 84 | 51 | 3.1 | | | |
| 8 (comparative) | 1.3 | 0.4 | 220 | 50 | 67 |

These examples illustrate the large increase in dry $R_L$ that can be achieved by inserting a spacing layer between a 1.5 refractive index optical element layer and a reflective layer. By using a spacing layer, dry retroreflectivity can be significantly improved using conventional glass optical elements which are the industry standard.

Examples 85–92

Ceramic optical elements having a refractive index of about 1.75 were embedded in the extruded spacing layer of Examples 24–66. The spacing layer thickness was varied from about 50 to about 88 microns. The glass optical elements were embedded and cupped by the extruded spacing layer in a similar manner as Examples 24–66 except the temperature was about 175° C. After cupping the spacing layer, the films were vaporcoated with about 900 angstroms of aluminum as described in Examples 12–17. The coefficient of retroreflection ($R_A$) was measured. Retroreflective elements were then made as previously described. A pavement marking example was then made from the retroreflective elements as previously described. The coefficient of retroreflected luminance $R_L$ was then measured on the pavement marking example.

| EXAMPLE | OPTICAL ELEMENT REFRACTIVE INDEX | OPTICAL ELEMENT TYPE | AVG. SIZE MICRONS | SPACING LAYER | REFLECTIVE LAYER |
|---|---|---|---|---|---|
| 85 | 1.75 | CERAMIC | 200 | 50 MICRON EXTRUDED | A1 VAPORCOAT |
| 86 | 1.75 | CERAMIC | 200 | 63 MICRON EXTRUDED | A1 VAPORCOAT |
| 87 | 1.75 | CERAMIC | 200 | 75 MICRON EXTRUDED | A1 VAPORCOAT |
| 88 | 1.75 | CERAMIC | 200 | 88 MICRON EXTRUDED | A1 VAPORCOAT |
| 89 | 1.75 | CERAMIC | 250 | 50 MICRON EXTRUDED | A1 VAPORCOAT |
| 90 | 1.75 | CERAMIC | 250 | 63 MICRON EXTRUDED | A1 VAPORCOAT |
| 91 | 1.75 | CERAMIC | 250 | 75 MICRON EXTRUDED | A1 VAPORCOAT |
| 92 | 1.75 | CERAMIC | 250 | 88 MICRON EXTRUDED | A1 VAPORCOAT |

-continued

| | COEFFICIENT OF RETROREFLECTION IN Cd/LX/M$^2$ | | CALCULATED COEFFICIENT OF RETROREFLECTED LUMINANCE - $R_L$ (mCd/m$^2$/Lx) | | |
|---|---|---|---|---|---|
| | DRY | WET | SLOW WATER DRAINAGE | | |
| EXAMPLE | −4.0/0.2 | −4.0/0.2 | DRY | RAIN | RECOVERY |
| 85 | 180 | 1.7 | 1700 | 130 | 130 |
| 86 | 60 | 2.3 | | | |
| 87 | 56 | 1.2 | | | |
| 88 | 12 | 5.0 | | | |
| 89 | 80 | 0.7 | | | |
| 90 | 130 | 1.0 | | | |
| 91 | 60 | 2.0 | | | |
| 92 | 60 | 2.5 | | | |
| 5 (comparative) | 8.5 | 0.8 | 950 | 140 | 100 |

These examples illustrate the large increase in dry $R_L$ that can be achieved by inserting a spacing layer between a 1.75 refractive index optical element and a reflective layer.

| EXAMPLE | WT. % 1.91 $N_D$ CERAMIC | WT. % 1.5 $N_D$ GLASS | AREA % 1.91 $N_D$ CERAMIC | AVG. SIZE MICRONS | SPACING LAYER | REFLECTIVE LAYER |
|---|---|---|---|---|---|---|
| 93 | 0% | 100% | 0% | 165 | 113 MICRON EXTRUDED | A1 VAPORCOAT |
| 94 | 34.8% | 65.2% | 25% | 165 | 113 MICRON EXTRUDED | A1 VAPORCOAT |
| 95 | 61.5% | 38.5% | 50% | 165 | 113 MICRON EXTRUDED | A1 VAPORCOAT |
| 96 | 82.8% | 17.2% | 75% | 165 | 113 MICRON EXTRUDED | A1 VAPORCOAT |
| 97 | 100% | 0% | 100% | 165 | 113 MICRON EXTRUDED | A1 VAPORCOAT |

| | COEFFICIENT OF RETROREFLECTION IN Cd/LX/M$^2$ | | CALCULATED COEFFICIENT OF RETROREFLECTED LUMINANCE - $R_L$ (mCd/m$^2$/Lx) | | |
|---|---|---|---|---|---|
| | DRY | WET | SLOW WATER DRAINAGE | | |
| EXAMPLE | −4.0/0.2 | −4.0/0.2 | DRY | RAIN | RECOVERY |
| 93 | 49 | 1.8 | | | |
| 94 | 31 | 8.6 | | | |
| 95 | 34 | 19 | | | |
| 96 | 17 | 35 | 530 | 200 | 280 |
| 97 | 3.0 | 57 | | | |
| 5 (Comparative) | 8.5 | 0.8 | 950 | 140 | 100 |
| 8 (Comparative) | 1.3 | 0.4 | 220 | 50 | 67 |

Examples 93–97

Ceramic optical elements having a refractive index of about 1.91 were screened to an average size of about 165 microns. Glass optical elements having a refractive index of about 1.5 were screened to an average size of about 165 microns. Mixtures of the optical elements were embedded in the extruded spacing layer of Examples 24–66. The spacing layer thickness was about 113 microns. The optical element mixture was embedded and cupped by the extruded spacing layer in a similar manner as Examples 24–66. After cupping the spacing layer, the films were vaporcoated with about 900 angstroms of aluminum as described in Examples 12–17. The coefficient of retroreflection ($R_A$) was measured. Retroreflective elements were then made as previously described. A pavement marking example was then made from the retroreflective elements as previously described. The coefficient of retroreflected luminance $R_L$ was then measured on the pavement marking example.

These examples illustrate that the dry and raining $R_L$ performance for a diffuse reflecting optical system with low refractive index optical elements (8 comparative) can be significantly increased by using a spacing layer between a mixture of low and high refractive index optical elements (i.e., 1.5 and 1.9) and the refractive layer.

Examples 98–102

Ceramic optical elements having a refractive index of about 1.91 were screened to an average size of about 165 microns. Ceramic optical elements having a refractive index of about 1.75 were screened to an average size of about 350 microns. Mixtures of the optical elements were embedded in the extruded spacing layer of Examples 24–66. The spacing layer thickness was about 100 microns. The optical element mixture was embedded and cupped by the extruded spacing layer in a similar manner as Examples 24–66. After cupping the spacing layer, the films were vaporcoated with about 900 angstroms of aluminum as described in Examples 12–17. The coefficient of retroreflection ($R_A$) was measured. Retroreflective elements were then made as previously described. A pavement marking example was then made from the retroreflective elements as previously described. The coefficient of retroreflected luminance $R_L$ was then measured on the pavement marking example.

| EXAMPLE | WT. % 1.91 $N_D$ CERAMIC 165 MICRONS AVG. SIZE | WT. % 1.75 $N_D$ CERAMIC 165 MICRONS AVG. SIZE | AREA % 1.91 $N_D$ CERAMIC 165 MICRON AVG. SIZE | SPACING LAYER | REFLECTIVE LAYER |
|---|---|---|---|---|---|
| 98 | 0% | 100% | 0% | 100 MICRON EXTRUDED | A1 VAPORCOAT |
| 99 | 13.5% | 86.5% | 25% | 100 MICRON EXTRUDED | A1 VAPORCOAT |
| 100 | 31.8% | 68.2% | 50% | 100 MICRON EXTRUDED | A1 VAPORCOAT |
| 101 | 58.4% | 41.6% | 75% | 100 MICRON EXTRUDED | A1 VAPORCOAT |
| 102 | 100% | 0% | 100% | 100 MICRON EXTRUDED | A1 VAPORCOAT |

| | COEFFICIENT OF RETROREFLECTION IN Cd/LX/M$^2$ | | CALCULATED COEFFICIENT OF RETROREFLECTED LUMINANCE - $R_L$ (mCd/m$^2$/Lx) | | |
|---|---|---|---|---|---|
| | DRY | WET | SLOW WATER DRAINAGE | | |
| EXAMPLE | −4.0/0.2 | −4.0/0.2 | DRY | RAIN | RECOVERY |
| 98 | 140 | 0.90 | | | |
| 99 | 110 | 14 | | | |
| 100 | 85 | 27 | | | |
| 101 | 46 | 47 | 730 | 480 | 600 |
| 102 | 7.4 | 51 | | | |
| 5 (Comparative) | 8.5 | 0.8 | 950 | 140 | 100 |
| 6 (Comparative) | 15.4 | 0.9 | 1400 | 190 | 190 |

These examples illustrate that excellent contrast (both dry and wet) can be obtained using a blend of small high refractive index optical elements (i.e., 165 micron, 1.9 refractive index) with large medium refractive index (i.e., 350 micron, 1.75 refractive index). Diffuse reflecting medium and high refractive index optical elements (5 and 6 comparative) cannot achieve this level of wet $R_L$ performance.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A pavement marking article comprising:

a) a monolayer of exposed-lens optical elements;

b) a reflective layer; and c) a spacing layer between the optical elements and the reflective layer, the average thickness of the spacing layer relative to the average radius of the optical elements being selected such that when wet the article has a coefficient of retroreflection, $R_A$, greater than 3.1 Cd/LX/M$^2$.

2. The pavement marking article according to claim 1, wherein said optical elements comprise material selected from the group consisting of glass, ceramic, or mixtures thereof.

3. The pavement marking article according to claim 1, wherein said optical elements have a refractive index ranging from about 1.5 to about 2.4.

4. The pavement marking article according to claim 1, wherein said optical elements have the same refractive index.

5. The pavement marking article according to claim 1, wherein said optical elements have two or more refractive indices.

6. The pavement marking article according to claim 1, wherein s aid optical elements have an average diameter ranging from about 50 micrometers to about 1000 micrometers.

7. The pavement marking article according to claim 1, wherein said optical elements have the same average diameter.

8. The pavement marking article according to claim 1, wherein said optical elements have two or more average diameters.

9. The pavement marking article according to claim 1, wherein said optical elements have an exposed surface and an embedded surface and said spacing layer is layered on the embedded surface of said optical elements.

10. The pavement marking article according to claim 1, wherein said spacing layer comprises material selected from the group consisting of polyvinyl butyral, polyurethanes, polyesters, acrylics, acid olefin copolymers, polyvinyl chloride and its copolymers, epoxies, polycarbonates, and mixtures thereof.

11. The pavement marking article according to claim 1, wherein said spacing layer comprises additives selected from the group consisting of stabilizers, colorants, antioxidants, ultraviolet absorbers, and mixtures thereof.

12. The pavement marking article according to claim 1, wherein said spacing layer has a refractive index ranging from about 1.4 to about 1.7.

13. The pavement marking article according to claim 1, wherein said optical elements have a radius and said spacing layer has a thickness ranging from about 0.05 to about 1.4 relative to the optical element radius.

14. The pavement marking article according to claim 1, wherein said spacing layer has the same thickness downweb and crossweb.

15. The pavement marking article according to claim 1, wherein said spacing layer has two or more thicknesses downweb.

16. The pavement marking article according to claim 1, wherein said spacing layer has two or more thicknesses crossweb.

17. The pavement marking article according to claim 1, wherein said spacing layer cups around said optical elements.

18. The pavement marking article according to claim 1, wherein said reflective layer comprises a diffuse reflector.

19. The pavement marking article according to claim 18, wherein said diffuse reflector comprises a diffuse pigment selected from the group consisting of titanium dioxide, zinc oxide, zinc sulfide, lithophone, zirconium silicate, zirconium oxide, natural and synthetic barium sulfates, and mixtures thereof.

20. The pavement marking article according to claim 1, wherein said reflective layer comprises a specular reflector.

21. The pavement marking article according to claim 20, wherein said specular reflector is selected from the group consisting of specular pigment, metallized layer, or a dielectric materials.

22. The pavement marking article according to claim 1, wherein said article further comprises a core layer.

23. The pavement marking article according to claim 22, wherein said article further comprises one or more binder layers between the reflective layer and the core layer.

24. The pavement marking article according to claim 22, wherein said article is a retroreflective element.

25. The pavement marking article according to claim 24, wherein said retroreflective element is adhered to a roadway via a roadway binder.

26. The pavement marking article according to claim 24, wherein said retroreflective element is adhered to a preformed pavement marking tape.

27. The pavement marking article according to claim 1, wherein said article is a preformed pavement marking tape.

28. The pavement marking article according to claim 27, wherein said preformed pavement marking tape is selected from the group consisting of flat pavement marking tapes and patterned pavement marking tapes.

29. The pavement marking article according to claim 27, wherein said preformed pavement marking tape further comprises an adhesive layer.

30. The pavement marking article according to claim 1, wherein said article is a retroreflective flake.

31. The pavement marking article according to claim 30, wherein said retroreflective flake comprises one or more binder layers behind the reflective layer.

32. A pavement marking article according to claim 1, wherein when said optical elements are coated with water the retroreflectivity increases.

* * * * *

UNITED STATES PATENT AND TRADEMARK OFFICE

CERTIFICATE OF CORRECTION

PATENT NO. : 6,479,132 B2
DATED : November 12, 2002
INVENTOR(S) : Hedblom, Thomas P.

It is certified that error appears in the above-identified patent and that said Letters Patent is hereby corrected as shown below:

Title Page
Item [62], Related U.S. Application Data, delete "Division" and insert in place thereof -- Divisional --.

Column 5,
Line 27, delete "traffic- bearing" and insert in place thereof -- traffic-bearing --.

Column 6,
Line 64, delete "elemen" and insert in place thereof -- element --.

Column 7,
Line 37, delete "multi- layered" and insert in place thereof -- multi-layered --.

Column 8,
Line 26, delete "Cookson," and insert in place thereof -- Cookson --.
Line 58, delete "No." and insert in place thereof -- Nos. --.

Column 9,
Line 2, delete "are" and insert in place thereof -- is --.
Line 13, delete "(millimeters)." and insert in place thereof -- (millimeters$^2$. --.
Line 40, delete "Organic" and insert in place thereof -- "Organic --.
Line 41, delete "Appearance" and insert in place thereof -- Appearance" --.
Line 47, delete "3/16inch to about 3/8inch" and insert in place thereof -- 3/16 inch to about 3/8 inch --.
Line 48, delete "3/16to" and insert in place thereof -- 3/16 to --.

Column 10,
Line 4, delete "present" and insert in place thereof -- presence --.
Line 32, delete "skid- resistant" and insert in place thereof -- skid-resistance --.
Line 67, delete "Co." and insert in place thereof -- Co., -- .

Column 13,
Line 12, preceding "Glass" insert -- 1.5 --.
Line 42, delete "$Zr_2$" and insert in place thereof -- $ZrO_2$ --

UNITED STATES PATENT AND TRADEMARK OFFICE

CERTIFICATE OF CORRECTION

PATENT NO. : 6,479,132 B2
DATED : November 12, 2002
INVENTOR(S) : Hedblom, Thomas P.

It is certified that error appears in the above-identified patent and that said Letters Patent is hereby corrected as shown below:

Column 14,
Line 11, delete "3:00:1.00:0.81" and insert in place thereof -- 3:00:1.00:0.81. --.
Line 12, delete "RA" and insert in place thereof -- $R_A$ --.

Column 15,
Line 20, delete "polyisocyante" and insert in place thereof -- polyisocyanate --.

Column 16,
Line 29, delete "Examples 5-6" and insert in place thereof -- Examples 5-8 --.

Column 17,
Line 47, delete "1120" and insert in place thereof -- 1200 --.

Column 20,
Line 37, delete "1000" and insert in place thereof -- 1100 --.

Column 21
Line 18, delete "330" and insert in place thereof -- 830 --.

Column 23
Line 15, delete "800" and insert in place thereof -- 1800 --.

Column 27,
Line 25, delete "comparative" and insert in place thereof -- Comparative --.
Line 47, delete "desirably" and insert in place thereof -- desirable --.

Column 31,
Line 36, delete "Wv" and insert in place thereof -- WV --.
Line 38, delete "7005" and insert in place thereof -- 700S-.
Line 42, delete "aide" and insert in place thereof -- aid --.

Column 32,
Line 3, delete "Dupont" and insert in place thereof -- Dupont, --.

Column 33,
Line 29, delete "comparative" and insert in place thereof -- Comparative --.

UNITED STATES PATENT AND TRADEMARK OFFICE

CERTIFICATE OF CORRECTION

PATENT NO. : 6,479,132 B2
DATED : November 12, 2002
INVENTOR(S) : Hedblom, Thomas P.

It is certified that error appears in the above-identified patent and that said Letters Patent is hereby corrected as shown below:

Column 35,
Line 16, delete "comparative" and insert in place thereof -- Comparative --.

Column 37,
Line 14, delete "165" and insert in place thereof -- 350 --.

Column 38
Line 51, delete "s aid" and insert in place thereof -- said --.

Column 39,
Line 34, delete "a".

Signed and Sealed this

Twenty-third Day of September, 2003

JAMES E. ROGAN
*Director of the United States Patent and Trademark Office*